US011446939B2

(12) United States Patent
Aoki

(10) Patent No.: US 11,446,939 B2
(45) Date of Patent: Sep. 20, 2022

(54) RECORDING DEVICE, TRANSPORT DEVICE

(71) Applicant: SEIKO EPSON CORPORATION, Tokyo (JP)

(72) Inventor: Hiroki Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/201,690

(22) Filed: Mar. 15, 2021

(65) Prior Publication Data

US 2021/0291559 A1 Sep. 23, 2021

(30) Foreign Application Priority Data

Mar. 17, 2020 (JP) ..... JP2020-046075

(51) Int. Cl.
*B41J 11/00* (2006.01)

(52) U.S. Cl.
CPC ..... *B41J 11/007* (2013.01)

(58) Field of Classification Search
CPC ..... B41J 11/007; B41J 29/17; B41J 3/4078; B41J 15/04; B41J 2/16538; B41J 15/048; B41J 2/16544
See application file for complete search history.

(56) References Cited

U.S. PATENT DOCUMENTS

2014/0198161 A1* 7/2014 Kanemoto ..... B41J 29/17 347/101
2014/0247314 A1* 9/2014 Momose ..... B41J 11/005 347/104

FOREIGN PATENT DOCUMENTS

JP 2011-073813 A 4/2011

* cited by examiner

*Primary Examiner* — Jannelle M Lebron
(74) *Attorney, Agent, or Firm* — Workman Nydegger

(57) ABSTRACT

A recording device includes a recording unit capable of performing recording on a medium, a transporting belt capable of transporting the medium, and a first contact portion and a second contact portion that contact the transporting belt, and are inclined in mutually different directions with respect to a movement direction of the transporting belt, wherein when a direction orthogonal to the movement direction and along the transporting belt is an orthogonal direction, a range, in which the first contact portion and the second contact portion are provided, in the orthogonal direction is wider than a width dimension of the transporting belt in the orthogonal direction, and an interval between the first contact portion and the second contact portion in the orthogonal direction increases in the movement direction.

6 Claims, 14 Drawing Sheets

RECORDING DEVICE, TRANSPORT DEVICE

The present application is based on, and claims priority from JP Application Serial Number 2020-046075, filed Mar. 17, 2020, the disclosure of which is hereby incorporated by reference herein in its entirety.

BACKGROUND

1. Technical Field

The present disclosure relates to a recording device and a transport device.

2. Related Art

In the past, as illustrated in JP 2011-73813 A, a recording device has been known that includes an endless belt for transporting a recording medium, a recording head for discharging ink onto the recording medium being transported, and a cleaning unit as a contact portion that contacts the endless belt. The cleaning unit of the recording device includes a wiping blade that contacts an outer circumferential surface of the endless belt.

However, the wiping blade of the above recording device is inclined in one direction with respect to a direction in which the endless belt moves, and is disposed in a range that does not exceed a width of the endless belt, thus there is a problem in that a difference in a width direction occurs in tension acting on the endless belt on one end portion side and another end portion side of the wiping blade, and the endless belt is oblique in a direction in which tension is higher. When the endless belt is oblique, an application position of ink onto the recording medium shifts, which may lead to a decrease in quality of a recording object.

SUMMARY

A recording device includes a recording unit capable of performing recording on a medium, a transporting belt capable of transporting the medium, and a first contact portion and a second contact portion that contact the transporting belt, and are inclined in mutually different directions with respect to a movement direction of the transporting belt, wherein when a direction orthogonal to the movement direction and along the transporting belt is an orthogonal direction, a range, in which the first contact portion and the second contact portion are provided, in the orthogonal direction is wider than a width dimension of the transporting belt in the orthogonal direction, and an interval between the first contact portion and the second contact portion in the orthogonal direction increases in the movement direction.

Note that, "an interval increases in the orthogonal direction" means that the interval increases continuously in stages.

A recording device includes a recording unit capable of performing recording on a medium, a transporting belt capable of transporting the medium, a first contact portion contacting the transporting belt, and inclined in a first direction intersecting a movement direction of the transporting belt, and a second contact portion contacting the transporting belt, and inclined in a second direction intersecting the movement direction and different from the first direction, wherein a range, in which the first contact portion and the second contact portion are provided, in an orthogonal direction orthogonal to the movement direction is wider than a width dimension of the transporting belt in the orthogonal direction, and when a straight line parallel to the movement direction and passing through a center of the width dimension of the transporting belt in the orthogonal direction is a virtual line, a distance in the orthogonal direction between a downstream end, in the movement direction, of the first contact portion and the virtual line is greater than a distance in the orthogonal direction between an upstream end, in the movement direction, of the first contact portion and the virtual line, and a distance in the orthogonal direction between a downstream end, in the movement direction, of the second contact portion and the virtual line is greater than a distance in the orthogonal direction between an upstream end, in the movement direction, of the second contact portion and the virtual line.

A transport device includes a transporting belt capable of transporting an object, and a first contact portion and a second contact portion contacting the transporting belt, and inclined in mutually different directions with respect to a movement direction of the transporting belt, wherein when a direction orthogonal to the movement direction and along the transporting belt is an orthogonal direction, a range, in which the first contact portion and the second contact portion are provided, in the orthogonal direction is wider than a width dimension of the transporting belt in the orthogonal direction, and an interval between the first contact portion and the second contact portion in the orthogonal direction increases in the movement direction.

DESCRIPTION OF EXEMPLARY EMBODIMENTS

1. First Exemplary Embodiment

Figure 1:
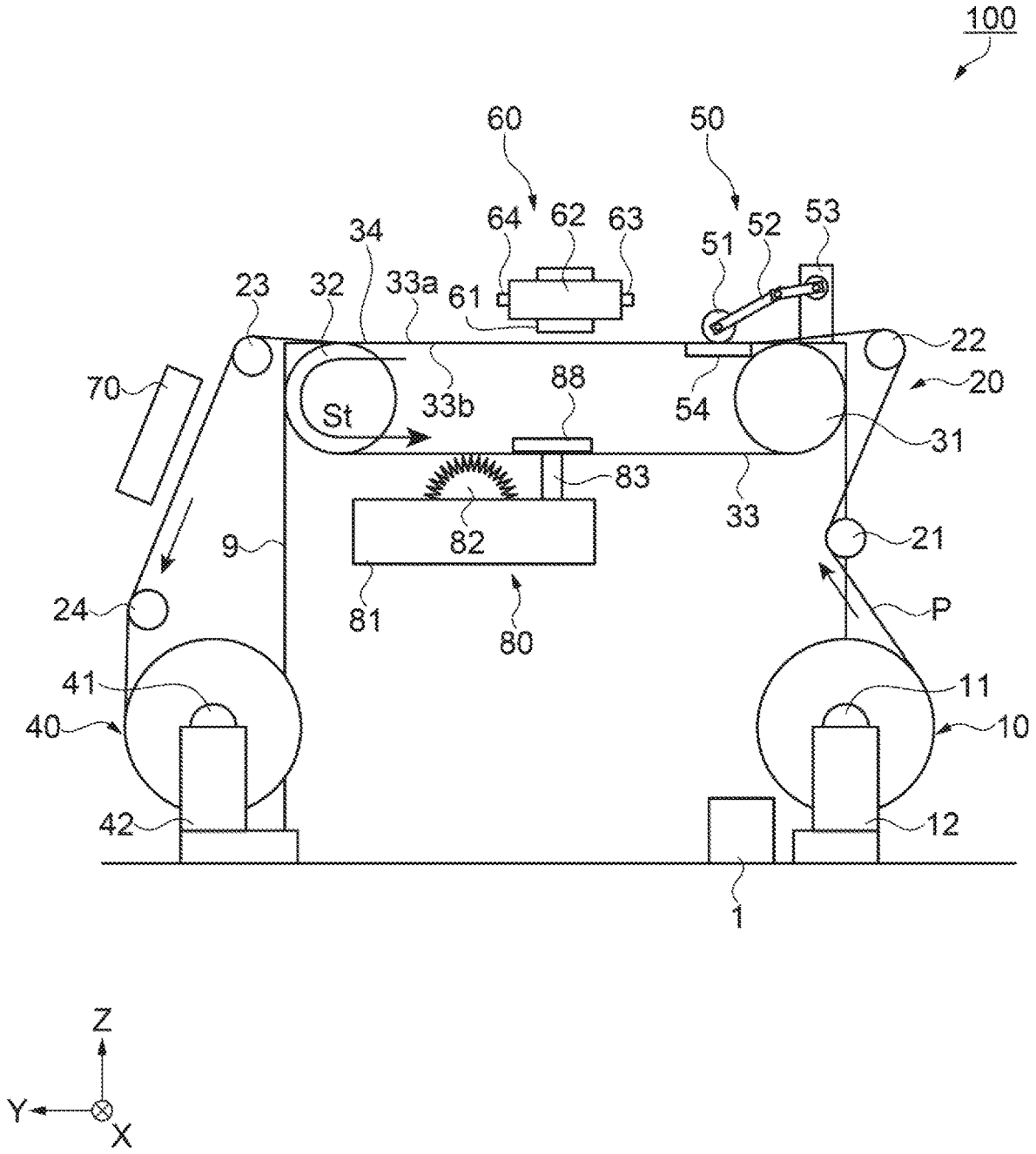
FIG. 1 is a schematic view illustrating a configuration of a recording device according to a first exemplary embodiment.

First, a schematic configuration of a recording device 100 will be described. In the present exemplary embodiment, the recording device 100 of an ink jet-type configured to record an image and the like onto a medium P to perform printing onto the medium P will be illustrated. In the drawings used in the following description, an X-axis, a Y-axis, and a Z-axis that are orthogonal to each other are illustrated. Note that, in coordinates added in the drawings, a direction along the Z-axis is defined as a Z direction, a direction along the Y-axis is defined as a Y direction, and a direction along the X-axis is defined as an X direction. The Y direction corresponds to a transport direction of the medium P facing the recording unit 60. Further, the X direction corresponds to a width direction of the medium P. In the following description, a tip side of an arrow indicating a direction is defined as a + direction, and a base end side of the arrow indicating the direction is defined as a − direction. A −Z direction is a gravitational direction in which gravity acts on the recording device 100, and a plane disposed along the X direction and the Y direction (XY plane) is a horizontal plane. For example, the X direction represents a +X direction or a −X direction.

As illustrated in FIG. 1, the recording device 100 includes a medium transport unit 20, a medium adhesion unit 50, a recording unit 60, a drying unit 70, a cleaning unit 80, and the like. Furthermore, a control unit 1 for controlling each unit is included. Each unit of the recording device 100 is attached to a frame 9.

The medium transport unit 20 transports the medium P along a transport path. The medium transport unit 20 includes a medium supply unit 10, transport rollers 21 to 24, a transporting belt 33, a belt-rotated roller 31, a belt-driving roller 32, and a medium collecting part 40. First, the transport path for the medium P from the medium supply unit 10 to the medium collecting part 40 will be described.

The medium supply unit 10 supplies the medium P to the transporting belt 33. As the medium P, there can be used, for example, natural fiber, cotton, silk, hemp, mohair, wool, cashmere, regenerated fiber, synthetic fiber, nylon, polyurethane, polyester, and woven cloth or non-woven cloth fabricated by mixed spinning of these fibers. To the woven cloth or the non-woven cloth, a pretreatment agent for promoting a color developing property and a fixing property may be applied.

The medium supply unit 10 includes a feeding shaft portion 11 around which a strip-shaped medium P is wound in a roll shape, a bearing portion 12 that detachably and rotatably supports both ends of a cylindrical feeding shaft portion 11, and a rotation driver for rotationally driving the feeding shaft portion 11. The rotation driver is rotationally driven, and the feeding shaft portion 11 rotates, thereby feeding the medium P. The transport rollers 21 and 22 relay the medium P fed from the medium supply unit 10 to the transporting belt 33.

The transporting belt 33 transports the medium P in the transport direction such that the medium P faces the recording unit 60. The transporting belt 33 has a belt shape including both end portions coupled to each other and is formed in an endless manner, and the transporting belt 33 is hung between the belt-rotated roller 31 and the belt-driving roller 32. The transporting belt 33 is held in a state where predetermined tension is applied thereto. A front surface 33*a* as an outer circumferential surface of the transporting belt 33 is provided with an adhesive layer 34 onto which the medium P adheres. The transporting belt 33 supports the medium P adhering to the adhesive layer 34 by the medium adhesion unit 50, which will be described later. This allows stretchable clothes and the like to be handled as the medium P. Furthermore, the transporting belt 33 circularly moves with a movement direction St described below as a circling direction. The movement direction St is the circling direction of the transporting belt 33 when recording is performed on the medium P by the recording unit 60. In other words, the movement direction St is the circling direction of the transporting belt 33 when the medium P moves in an order of the medium supply unit 10, the recording unit 60, and the medium collecting part 40. In FIG. 1, the movement direction St is illustrated as a counterclockwise direction. Note that, the transporting belt 33 can circularly move with a movement direction −St opposite to the movement direction St as the circling direction. The movement direction −St is, for example, when an operation of aligning a position of the medium P with respect to the recording unit 60 is performed, a direction in which the medium P is moved for fine tuning the position.

The belt-rotated roller 31 and the belt-driving roller 32 are provided inside the transporting belt 33, and support an inner circumferential surface 33*b* of the transporting belt 33. The belt-driving roller 32 includes a rotation driver (not illustrated) for rotationally driving the belt-driving roller 32. The belt-driving roller 32 is rotationally driven, and the transporting belt 33 rotationally moves, thus the belt-rotated roller 31 is driven to rotate. As a result, the medium P supported by the transporting belt 33 is transported in the transport direction, and an image is formed on the medium P by the recording unit 60 provided between the belt-rotated roller 31 and the belt-driving roller 32. Each of the belt-rotated roller 31 and the belt-driving roller 32 is rotatably supported by a main body frame (not illustrated) around a rotary shaft parallel to the X-axis. The main body frame is a member that supports each element constituting the recording device 100. Hereinafter, the X direction is also referred to as an axial direction from the perspective that the X direction corresponds to the rotary shaft of each of the belt-rotated roller 31 and the belt-driving roller 32.

Note that a configuration in which a support portion configured to support the inner circumferential surface 33*b* of the transporting belt 33 is provided between the belt-rotated roller 31 and the belt-driving roller 32 may be applied. Additionally, although it has been described that the transporting belt 33 includes the adhesive layer 34 to which the medium P adheres, for example, the transporting belt 33 may be an electrostatic attraction type transporting belt configured to attract a medium onto the belt by static electricity. In other words, the configuration is not particularly limited as long as the medium P adheres to the front surface 33*a*.

The transport roller 23 is configured to remove the medium P on which an image is formed from the transporting belt 33. The transport rollers 23 and 24 relay the removed medium P to the medium collecting part 40.

The medium collecting part 40 collects the medium P. The medium collecting part 40 includes a winding shaft part 41 that winds the medium P in a roll shape, a bearing portion 42 that detachably and rotatably supports both ends of the cylindrical winding shaft portion 41, and a rotation driver that rotationally drives the winding shaft part 41. The rotation driver is rotationally driven and the winding shaft part 41 rotates, thus the medium P is wound.

Next, each component provided along the transport path of the medium P will be described.

The medium adhesion unit 50 is provided upstream of the recording unit 60 in the movement direction St, and causes the medium P fed on the transporting belt 33 to adhere to the adhesive layer 34. The medium adhesion unit 50 includes a press roller 51 formed in a cylindrical shape, a roller support portion 52 that rotatably supports both ends of the press roller 51, a roller receptacle 54 that receives a load of the press roller 51 via the transporting belt 33, and a press roller driving portion 53 that drives the press roller 51. The press roller driving portion 53 is configured to move the press roller 51 in the transport direction (+Y direction) and a direction opposite to the transport direction (−Y direction). As a result, the medium P is pressed by the load of the pressing roller 51 and adheres to the adhesive layer 34.

The recording unit 60 is disposed above the transporting belt 33 in the Z direction, and performs recording on the medium P on the transporting belt 33. The recording unit 60 includes a head 61, a carriage 62 on which the head 61 is mounted, and guide rails 63 and 64 that support the carriage 62. The head 61 includes a plurality of nozzles that constitute a nozzle row, and an actuator that causes ink to be ejected from the nozzle. Each of the nozzles is supplied with ink such as cyan (C), magenta (m), yellow (Y), or black (K).

The guide rails 63 and 64 are each a rail that extends along the X-axis and reciprocably supports the carriage 62 in the width direction of the medium P.

The recording unit 60 includes a moving mechanism that moves the carriage 62 and a power source that drives the moving mechanism. As the moving mechanism, for example, a mechanism including a combination of a ball screw and a ball nut, a linear guide mechanism, or the like is employed. As the power source, there are employed, for example, a variety of motors such as a stepping motor, a servomotor, and a linear motor.

The drying unit 70 is provided upstream of the winding shaft part 41 in the transport direction of the medium P, and dries the medium P removed from the transporting belt 33. The drying unit 70 has an IR heater, for example, and dries ink impregnated in the medium P in a short period of time, when the IR heater is driven. Thus, the medium P after printing can be wound onto the winding shaft part 41. Note that, "drying ink" means, in addition to an aspect in which a solvent contained in the ink is completely evaporated, an aspect in which the solvent is evaporated to a degree that the medium P after printing can be wound around the winding shaft part 41.

The cleaning unit 80 performs cleaning of the transporting belt 33. The cleaning unit 80 is disposed between the belt-driving roller 32 and the belt-rotated roller 31, and cleans the front surface 33*a* of the transporting belt 33 after the medium P is removed from below in the Z direction. The cleaning unit 80 includes a cleaning tank 81, a cylindrical cleaning roller 82, a wiper blade 83 as a contact portion contacting the transporting belt 33, and a rotation driver (not illustrated) that rotationally drives the cleaning roller 82. The cleaning tank 81 is a tank for storing cleaning liquid. As the cleaning liquid, for example, water or a water-soluble solvent such as alcoholic aqueous solution is used, and a surfactant agent and an anti-foaming agent are added as necessary.

The cleaning roller 82 is rotatably supported inside the cleaning tank 81 such that an upper portion protrudes from the cleaning tank 81. In the present exemplary embodiment, the cleaning roller 82 is rotatably supported by the cleaning tank 81, with a shaft along the X direction as a rotary shaft. The cleaning roller 82 is, for example, a rotary brush in which a brush is formed at an outer circumferential surface of a rotating body having a cylindrical shape or a columnar shape. When the adhesive layer 34 is provided at the front surface 33*a*, a rotary brush may be employed as the cleaning roller 82. This is because an area of a tip of the rotary brush is small, and even when the tip of the rotary brush contacts the adhesive layer 34, inhibition of rotation of the rotating brush by adhesion of the tip to the adhesive layer 34 becomes less likely to occur. When the cleaning roller 82 is rotated, the cleaning roller 82 and the transporting belt 33 slide. Thus, ink attached onto the transporting belt 33, fiber and the like falling from fiber as of the medium P, and attached to a front surface of the adhesive layer 34 are removed.

Note that, a sponge roller constituted by a sponge having water absorbing properties may be adopted as the cleaning roller 82.

The wiper blade 83 has a plate shape and is formed of an elastic body such as rubber. The wiper blade 83 is located downstream of the cleaning roller 82, and is provided inside the cleaning tank 81 such that an upper end protrudes from the cleaning tank 81 toward the transporting belt 33. The wiper blade 83 contacts the front surface 33*a* of the transporting belt 33, and when the wiper blade 83 and the transporting belt 33 slide along with rotation of the transporting belt 33, thereby removing the cleaning fluid remaining on the front surface 33*a* of the transporting belt 33. The cleaning liquid removed by the wiper blade 83 is accommodated in the cleaning tank 81. A receptacle 88 is disposed to receive a load of the wiper blade 83 via the transporting belt 33. As a result, the load applied to the transporting belt 33 from the wiper blade 83 is held constant.

Note that, as described below, the wiper blade 83 is provided with, in addition to the function of removing the cleaning fluid remaining on the front surface 33*a* of the transporting belt 33, a function to prevent obliquity of the transporting belt 33, and a function to correct the oblique transporting belt 33.

The cleaning unit 80 has an elevator mechanism for raising and lowering the wiper blade 83. When cleaning of the transporting belt 33 is not performed or the transporting belt 33 is advanced in the direction opposite to the transport direction of the medium P, the wiper blade 83 is lowered, and the transporting belt 33 and the wiper blade 83 are separated. As a result, wear of the wiper blade 83 and obliquity of the transporting belt 33 can be suppressed. Note that, the elevator mechanism may be configured to raise and lower the entire cleaning unit 80.

Next, a detailed configuration of the wiper blade 83 will be described below.

Figure 2:
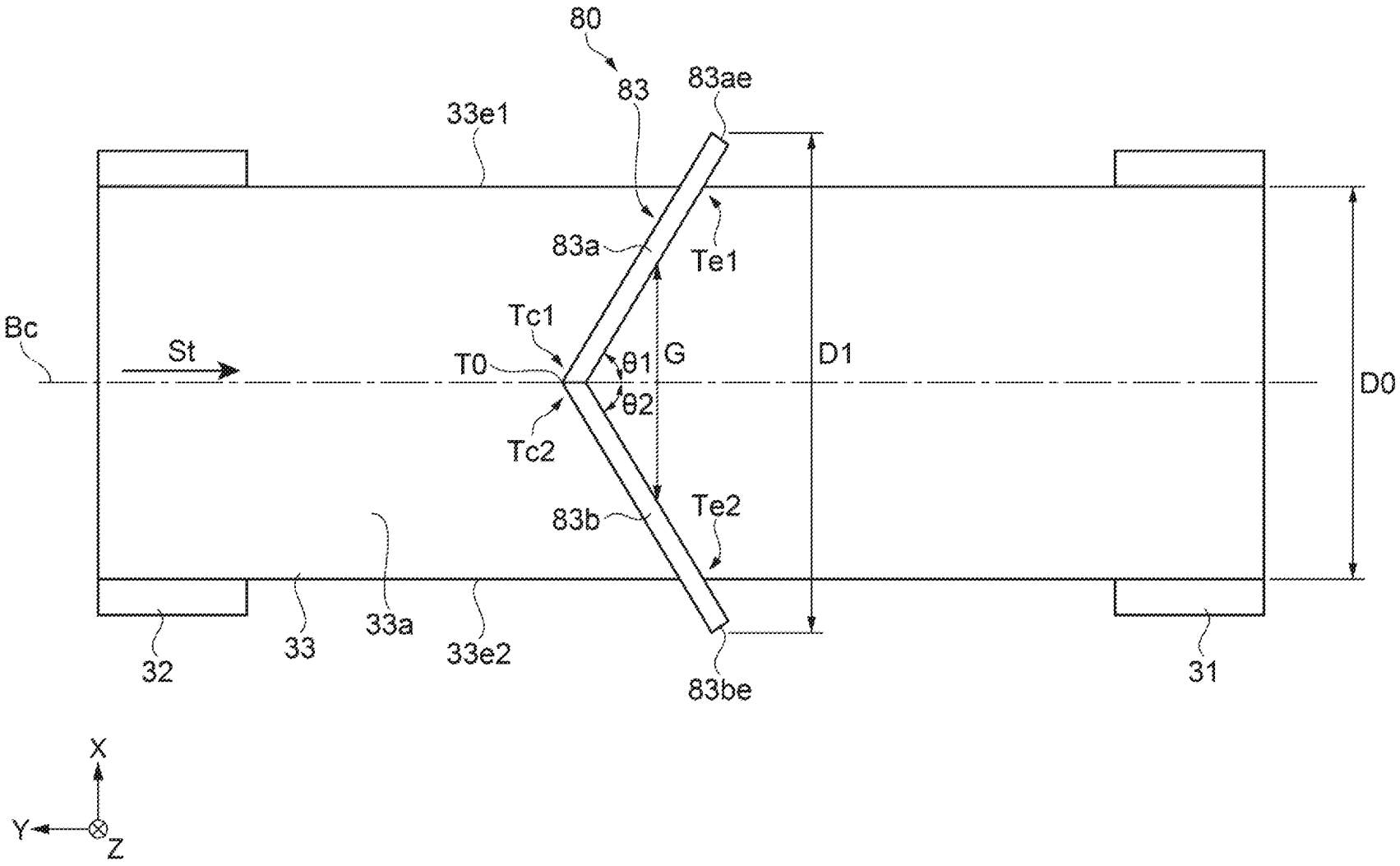
FIG. 2 is a plan view illustrating a configuration of a contact portion according to the first exemplary embodiment.

FIG. 2 is a plan view illustrating a configuration of the wiper blade 83, and is a diagram of the transporting belt 33 viewed from the −Z direction.

As illustrated in FIG. 2, the wiper blade 83 includes a first contact portion 83*a* and a second contact portion 83*b* that contact the front surface 33*a* of the transporting belt 33, and are inclined in mutually different directions with respect to the movement direction St of the transporting belt 33.

As described above, the movement direction St of the transporting belt 33 is the circling direction of the transporting belt 33, and the movement direction St in FIG. 2 is the −Y direction. The first contact portion 83*a* and the second contact portion 83*b* are both plate-like and have the same dimensions as each other.

The first contact portion 83*a* and the second contact portion 83*b* are not parallel, and the first contact portion 83*a* and the second contact portion 83*b* are disposed so as to intersect each other with respect to the movement direction St. In the present exemplary embodiment, a portion where the first contact portion 83*a* and the second contact portion 83*b* contact at the most upstream is referred to as a top portion T0, and the first contact portion 83*a* and the second contact portion 83*b* are disposed toward different directions respectively downstream of the top portion T0 in the movement direction St, with the top portion T0 as a starting point.

Further, when a direction orthogonal to the movement direction St of the transporting belt 33 and along the transporting belt 33 is an orthogonal direction (direction along the X-axis), a range D1 provided with the first contact portion 83*a* and the second contact portion 83*b* in the orthogonal direction is wider than a width dimension D0 of the transporting belt 33 in the orthogonal direction, and a gap G between the first contact portion 83*a* and the second contact portion 83*b* in the orthogonal direction increases in the movement direction St. In other words, the first contact portion 83*a* and the second contact portion 83*b* are disposed so as to be separated from each other while proceeding downstream of the top portion T0 in the movement direction St, starting from the top portion T0. In the present exemplary embodiment, the first contact portion 83*a* is disposed in the +X direction with respect to the second contact portion 83*b*.

Also, as illustrated in FIG. 2, the top portion T0 is located on a center line Bc in a width direction (direction along the X-axis) of the transporting belt 33, and an end portion 83*ae* on an opposite side to the top portion T0 of the first contact portion 83*a* protrudes from one end 33*e*1 in the +X direction of the transporting belt 33, that is, the end portion 83*ae* is located on a side of +X direction of the one end 33*e*1. Similarly, an end portion 83*be* of the second contact portion 83*b* on an opposite side to the top portion T0 protrudes from another end 33*e*2 in the −X direction of the transporting belt 33, that is, the end portion 83*be* is located on a side of the −X direction of the other end 33*e*2. As a result, the range D1 provided with the first contact portion 83*a* and the second contact portion 83*b* in the direction along the X-axis, that is, a dimension (range D1) in the direction along the X-axis from the end portion 83*ae* of the first contact portion 83*a* to the end portion 83*be* of the second contact portion 83*b* is greater than the width dimension D0 of the transporting belt 33.

Note that, an upper limit dimension of the range D1 provided with the first contact portion 83*a* and the second contact portion 83*b* is set as appropriate in consideration of, for example, the width dimension D0 of the transporting belt 33 and a range where the transporting belt 33 to be described later is oblique, and for example, a ratio of the range D1 to the width dimension D0 is about from 1.05 to 1.50.

Also, an angle θ1 formed by the center line Bc and the first contact portion 83*a*, and an angle θ2 formed by the center line Bc and the second contact portion 83*b* are substantially identical. The angles θ1 and θ2 are, for example, from 30° to 80°. That is, the first contact portion 83*a* and the second contact portion 83*b* are substantially symmetrical with respect to the center line Bc.

Next, how tension of the wiper blade 83 is applied to the transporting belt 33 will be described.

First, how tension is applied to the transporting belt 33 in the first contact portion 83*a* will be described.

In the first contact portion 83*a*, the top portion T0 is located upstream in the movement direction St, and the end portion 83*ae* is located downstream. In the first contact portion 83*a* disposed at an inclination with respect to the movement direction St, a difference in tension acting on the transporting belt 33 occurs between a central region Tc1 of the transporting belt 33 near the top portion T0 and an end portion region Te1 of the transporting belt 33 near the one end 33*e*1. Here, the one end 33*e*1 is an end portion of the transporting belt 33 on a side of the end portion 83*ae*, and is an end portion of the transporting belt 33 in the +X direction. Hereinafter, a phenomenon in which the above difference in tension occurs will be described. First, a first slack occurs in the end portion region Te1, and a second slack that is greater than the first slack occurs in the central region Tc1. This is because the top portion T0 is located upstream of the end portion 83*ae*. Therefore, tension is greater in the central region Tc1 than in the end portion region Te1. As a result, similar to a crown effect, a pressing pressure acts on the transporting belt 33 from a side where tension is lower toward a side where tension is higher, and the transporting belt 33 is oblique. Thus, for example, when only the first contact portion 83*a* of the wiper blade 83 is provided, the transporting belt 33 is oblique clockwise about the top portion T0 in FIG. 2. In addition, in practice, when only the first contact portion 83*a* of the wiper blade 83 is provided, a pressing pressure acts on the transporting belt 33 clockwise about the top portion T0, and the transporting belt 33 moves in the −X direction from an ideal state.

Second, how tension is applied to the transporting belt 33 in the second contact portion 83*b* will be described.

In the second contact portion 83*b*, the top portion T0 is located upstream in the movement direction St, and the end portion 83*be* is located downstream. In the second contact portion 83*b* disposed at an inclination with respect to the movement direction St, similar to the above, a difference in tension acting on the transporting belt 33 occurs between a central region Tc2 of the transporting belt 33 near the top portion T0 and an end portion region Te2 of the transporting belt 33 near the other end 33*e*2. Here, the other end 33*e*2 is an end portion of the transporting belt 33 on a side of the end portion 83*be*, and is an end portion of the transporting belt 33 in the −X direction. Hereinafter, a phenomenon in which the above difference in tension occurs will be described. First, a third slack occurs in the end portion region Te2, and a fourth slack that is greater than the third slack occurs in the central region Tc2. This is because the top portion T0 is located upstream of the end portion 83*be*. Therefore, tension is greater in the central region Tc2 than in the end portion region Te2. As a result, a pressing pressure acts on the transporting belt 33 from a side where tension is lower toward a side where tension is higher, and the transporting belt 33 is oblique. Thus, for example, when only the second contact portion 83*b* of the wiper blade 83 is provided, the transporting belt 33 is oblique counterclockwise about the top portion T0 in FIG. 2. In addition, in practice, when only the second contact portion 83*b* of the wiper blade 83 is provided, a pressing pressure acts on the transporting belt 33 counterclockwise about the top portion T0, and the transporting belt 33 moves in the +X direction from the ideal state.

Note that, the movement direction St in the ideal state in which the transporting belt 33 is not oblique is a direction along the Y-axis. On the other hand, the obliquity of the transporting belt 33 in the present exemplary embodiment refers to a state in which the movement direction St intersects the direction along the Y-axis. In practice, however, the transporting belt 33 is stretched over the belt-rotated roller 31 and the belt-driving roller 32, and a movement range in directions other than the X direction is restricted, thus the transporting belt 33 moves in the X direction from a position in the ideal state of the transporting belt 33. Therefore, the obliquity of the transporting belt 33 in the present exemplary embodiment includes obliquity clockwise or counterclockwise of the transporting belt 33 about the top portion T0 from the ideal state, and a movement along the X direction.

As described above, when only the first contact portion 83*a* of the wiper blade 83 is provided, or when only the second contact portion 83*b* is provided, the transporting belt 33 is oblique in a different direction. Therefore, because the wiper blade 83 according to the present exemplary embodiment includes the first contact portion 83*a* and the second contact portion 83*b*, a pressing pressure acting from the end portion region Te1 toward the central region Tc1 in the first contact portion 83*a* and a pressing pressure acting from the end portion region Te2 toward the central region Tc2 in the second contact portion 83*b* are balanced in a region of the top portion T0, in the ideal state in which the transporting belt 33 is not oblique. In other words, a tension difference in the first contact portion 83*a* and a tension difference in the second contact portion 83*b* are equivalent. As a result, the obliquity of the transporting belt 33 is suppressed.

Further, for example, when the wiper blade 83 is brought into contact with the transporting belt 33 in a state of being oblique clockwise or counterclockwise in FIG. 2, a size of a contact region of the first contact portion 83*a* with the transporting belt 33 differs from a size of a contact region of the second contact portion 83*b* with the transporting belt 33. In this state, the tension difference in the first contact portion 83*a* and the tension difference in the second contact portion 83*b* are different, thus the pressing pressure by the first contact portion 83*a* and the pressing pressure by the second contact portion 83*b* do not balance in the region of the top portion T0. As a result, the transporting belt 33 moves in a direction where the pressing pressure acts more greatly. Finally, the transporting belt 33 moves to a position where the pressing pressure in the first contact portion 83*a* and the pressing pressure in the second contact portion 83*b* are equivalent. That is, by adopting the configuration in which the range D1 provided with the first contact portion 83*a* and the second contact portion 83*b* in the orthogonal direction is wider than the width dimension D0 of the transporting belt 33 in the orthogonal direction, the transporting belt 33 in an oblique state is corrected to the ideal state due to the contact of the wiper blade 83.

Next, an action of the wiper blade 83 in the recording device 100 will be described.

Figure 3A:
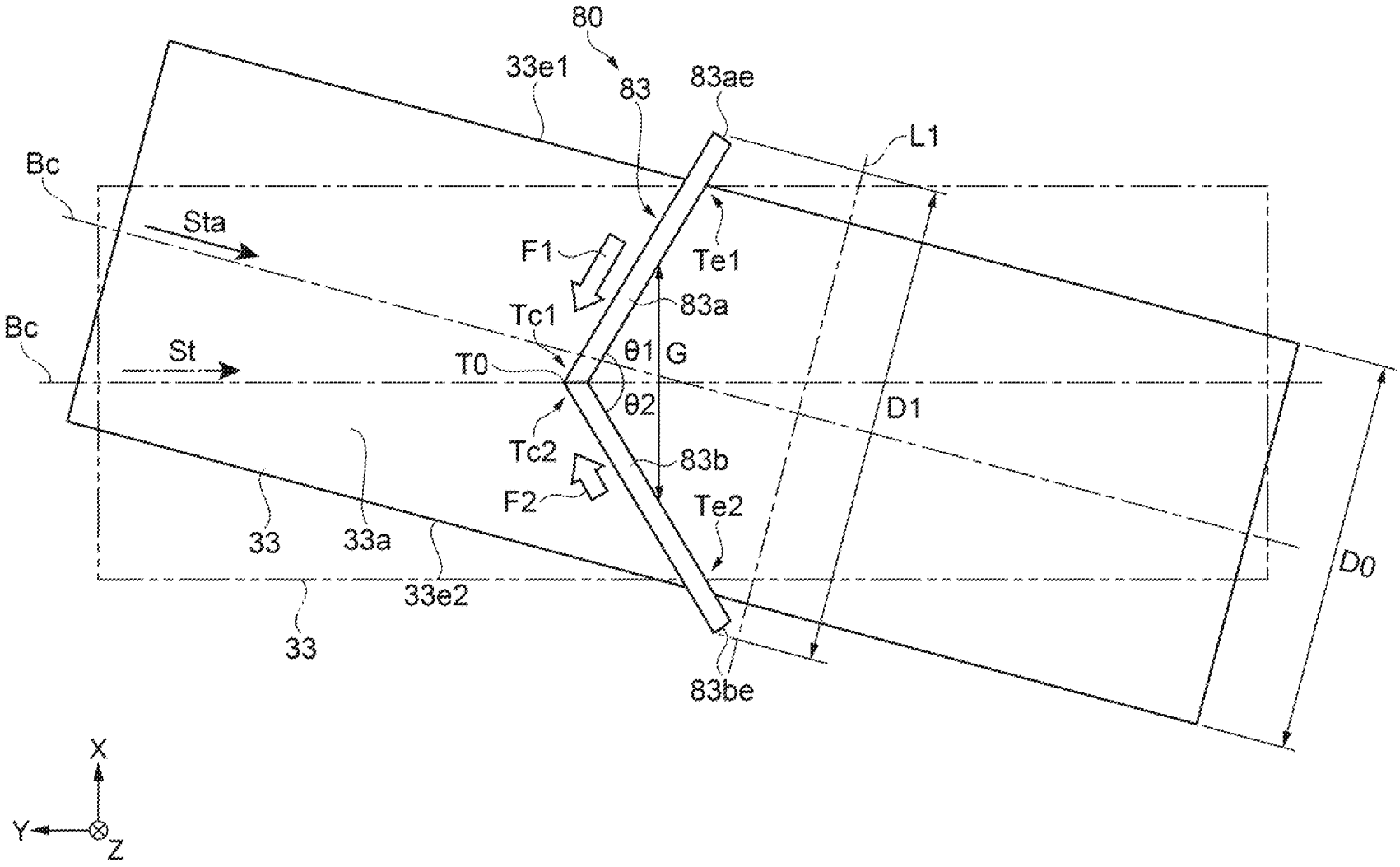
FIG. 3A is a schematic view illustrating an action of the contact portion according to the first exemplary embodiment.
Figure 3B:
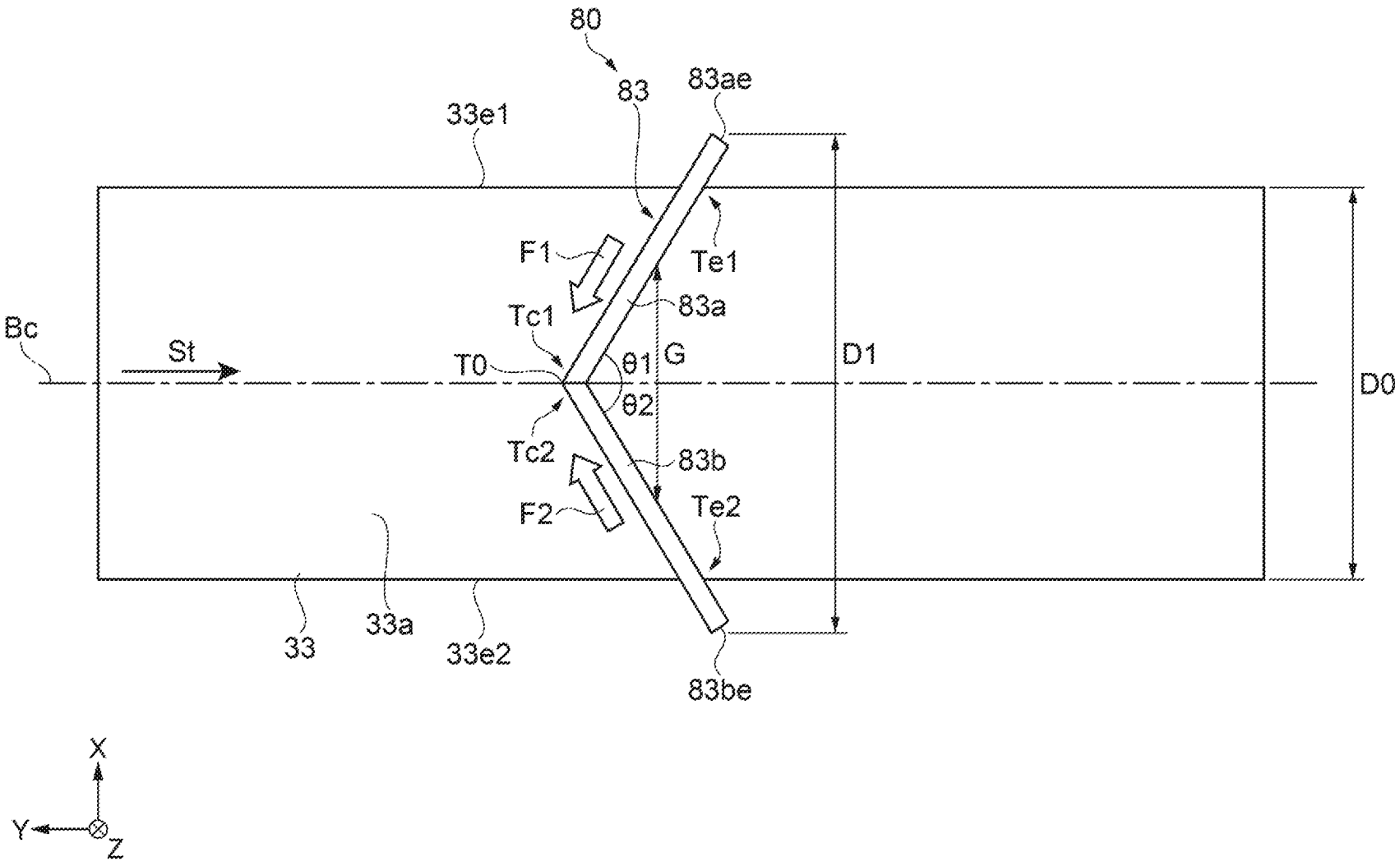
FIG. 3B is a schematic view illustrating the action of the contact portion according to the first exemplary embodiment.

In the present exemplary embodiment, as illustrated in FIG. 3A and FIG. 3B, a state in which an upstream side of the transporting belt 33 is located in the +X direction of a downstream side, that is, a case will be described in which the wiper blade 83 is brought into contact with the transporting belt 33 in a state of being oblique in a clockwise direction, to correct the obliquity of the transporting belt 33. Note that, for ease of explanation, the belt-rotated roller 31 and the belt-driving roller 32 are omitted in FIG. 3A and FIG. 3B, and the oblique state of the transporting belt 33 is illustrated as exaggerated.

Here, as a cause of obliquity of the transporting belt 33, an initial state in which the transporting belt 33 is stretched over the belt-rotated roller 31 and the belt-driving roller 32 during assembly of the recording device 100, a case where a rotary shaft of the cleaning roller 82 is inclined with respect to the X-axis during operation of the recording device 100, a case where a circumferential length of the transporting belt 33 in the +X direction differs from a circumferential length of the transporting belt 33 in the −X direction due to a manufacturing error of the transporting belt 33, and the like are conceivable.

Note that, the movement direction St in the ideal state where the transporting belt 33 is not oblique is the direction along the Y-axis, and a movement direction Sta of the oblique transporting belt 33 is a direction that intersects the movement direction St along the Y-axis. Here, the movement direction of the transporting belt 33 in the present exemplary embodiment is a concept including the movement direction St and the movement direction Sta.

The wiper blade 83 is disposed such that the transporting belt 33 is in the ideal state. Specifically, when the movement direction St is the direction along the Y-axis, the wiper blade 83 is disposed in a state where the first contact portion 83*a* and the second contact portion 83*b* are symmetric with respect to the center line Bc.

As illustrated in FIG. 3A, the wiper blade 83 is brought into contact with the oblique transporting belt 33. Here, the first contact portion 83*a* and the second contact portion 83*b* are inclined in mutually different directions with respect to the movement direction Sta of the transporting belt 33. Then, when a direction orthogonal to the movement direction Sta and along the transporting belt 33 is an orthogonal direction L1, the range D1 provided with the first contact portion 83*a* and the second contact portion 83*b* in the orthogonal direction L1 is wider than the width dimension D0 of the transporting belt 33 in the orthogonal direction L1, and the gap G between the first contact portion 83*a* and the second contact portion 83*b* in the orthogonal direction L1 increases in the movement direction Sta.

When the wiper blade 83 contacts the oblique transporting belt 33, a difference in tension acting on the transporting belt 33 occurs between the central region Tc1 near the top portion T0 of the first contact portion 83*a* and the end portion region Te1 on a side of the end portion 83*ae*. Similarly, a difference in tension acting on the transporting belt 33 occurs between the central region Tc2 near the top portion T0 of the second contact portion 83*b* and the end portion region Te2 on a side of the end portion 83*be*. However, a size of a region of the first contact portion 83*a* that contacts the transporting belt 33 is different from a size of a region of the second contact portion 83*b* that contacts the transporting belt 33. Specifically, the contact region of the first contact portion 83*a* is greater than the contact region of the second contact portion 83*b*. This is because the range D1 provided with the first contact portion 83*a* and the second contact portion 83*b* in the orthogonal direction L1 is configured to be wider than the width dimension D0 of the transporting belt 33 in the orthogonal direction L1. In other words, when the range D1 is less than or equal to the width dimension D0, a size relationship between the size of the contact region of the first contact portion 83*a* and the size of the contact region of the second contact portion 83*b* along with the obliquity of the transporting belt 33 does not change. As a result, the tension difference in the first contact portion 83*a* is greater than the tension difference in the second contact portion 83*b*.

That is, a pressing pressure F1 that acts toward the central region Tc1 from the end portion region Te1 in the first contact portion 83*a* is greater than a pressing pressure F2 that acts toward the central region Tc2 from the end portion region Te2 in the second contact portion 83*b*. As a result, the transporting belt 33 moves in a direction where the pressing pressure acts more greatly. Specifically, the transporting belt 33 moves in the direction in which the pressing pressure F1 acts, that is, from the end portion region Te1 toward the central region Tc1.

As the transporting belt 33 moves, the region of the second contact portion 83*b* that contacts the transporting belt 33 increases, and the pressing pressure F2 that acts toward the central region Tc2 from the end portion region Te2 increases in the second contact portion 83*b*.

Then, as illustrated in FIG. 3B, the transporting belt 33 moves to a position where the pressing pressure F1 by the first contact portion 83*a* and the pressing pressure F2 of the second contact portion 83*b* balance. That is, the oblique transporting belt 33 is gradually corrected. When the pressing pressure F1 and the pressing pressure F2 are balanced, movement of the transporting belt 33 is restricted, and the transporting belt 33 is held in the movement direction St along the Y-axis. Further, movement of the transporting belt 33 in the direction along the X-axis is also regulated.

As described above, according to the present exemplary embodiment, even when the transporting belt 33 is oblique, the transporting belt 33 moves to a position where the pressing pressure F1 of the first contact portion 83*a* and a pressing pressure F2 of the second contact portion 83*b* are balanced with respect to the transporting belt 33. As a result, the obliquity of the transporting belt 33 can be corrected. Additionally, the movement direction St of the transporting belt 33 can be maintained in the direction along the Y-axis at the position where the pressing pressure F1 and the pressing pressure F2 are balanced.

As a result, a position of application of ink to the medium P is accurate, and quality of an image on the medium P can be improved.

Further, the wiper blade 83 includes the first contact portion 83*a* and the second contact portion 83*b*, and obliquity of the transporting belt 33 can be suppressed by a relatively easy configuration.

In addition, by incorporating the wiper blade 83 as the contact portion into a configuration of a part of the cleaning unit 80, the cleaning liquid easily flows from the top portion T0 upstream of the wiper blade 83 toward the end portions 83*ae* and 83*be* downstream, the cleaning liquid can be easily removed from the transporting belt 33, and the removed cleaning liquid can be easily accommodated in the cleaning tank 81. That is, by incorporating the wiper blade 83 into the configuration of the part of the cleaning unit 80, an anti-obliquity function of the transporting belt 33 and a removing function of the cleaning liquid can be retained, and the configuration of the recording device 100 can be simplified.

Note that, in the present exemplary embodiment, the effect of the wiper blade 83 on the oblique transporting belt 33 has been described, but, for example, a similar effect can be obtained even when the transporting belt 33 is shifted in one direction along the X direction from the ideal state. In such a case, as described above, a size of the region of the first contact portion 83*a* that contacts the transporting belt 33 differs from the size of the region of the second contact portion 83*b* that contacts the transporting belt 33, therefore, the tension difference in the first contact portion 83*a* and the tension difference in the second contact portion 83*b* are different. As a result, the transporting belt 33 moves in a direction in which the pressing pressure acts more greatly toward the central region Tc1 or the central region Tc2, and the movement is regulated at the position where the pressing pressure F1 by the first contact portion 83*a* and the pressing pressure F2 by the second contact portion 83*b* are balanced.

In the present exemplary embodiment, the wiper blade 83 has been described in which the first contact portion 83*a* and the second contact portion 83*b* have similar structure, but the present disclosure is not limited thereto. For example, it is sufficient that at least one of the first contact portion 83*a* and the second contact portion 83*b* is a wiper blade. In this case, for example, another may be a rotary brush. Even with this configuration, similar effects can be obtained.

In addition, in the present exemplary embodiment, the wiper blade 83 has been described as the part of the configuration of the cleaning unit 80, but the present disclosure is not limited thereto. Separate from the cleaning unit 80, the wiper blade 83 may be disposed as a contact portion in other regions. In this case, the wiper blade 83 may be configured to contact not only the front surface 33*a* of the transporting belt 33, but also the inner circumferential surface 33*b*. Even in this way, obliquity of the transporting belt 33 can be suppressed.

In addition, the cleaning unit 80 of the present exemplary embodiment has the configuration in which the front surface 33*a* of the transporting belt 33 is cleaned, but is not limited thereto, and a configuration may be adopted in which a cleaning unit that cleans the inner circumferential surface 33*b* of the transporting belt 33 is provided. Also, the wiper blade 83 need not be associated with the function of cleaning the front surface 33*a* of the transporting belt 33. In other words, a place where the wiper blade 83 is disposed is not particularly limited as long as the place is in contact with the front surface 33*a* or the inner circumferential surface 33*b* of the transporting belt 33 in the movement direction St.

2. Second Exemplary Embodiment

Next, a second exemplary embodiment will be described.

Note that, a basic configuration of the recording device 100 is similar to that of the first exemplary embodiment, and thus descriptions thereof will be omitted, and a configuration different from that of the first exemplary embodiment, that is, a configuration of a wiper blade 183 as a contact portion will be described.

Figure 4:
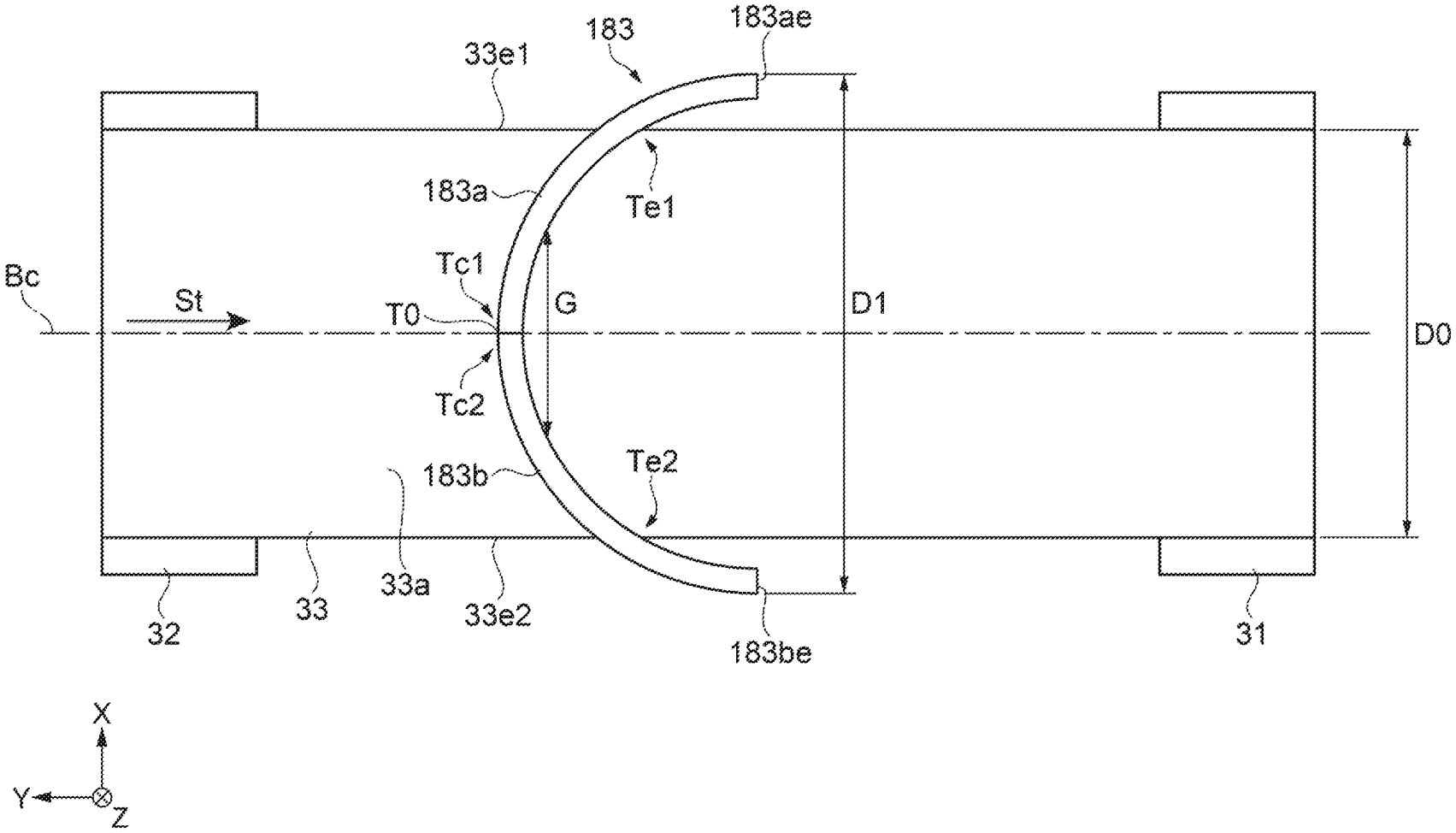
FIG. 4 is a plan view illustrating a configuration of a contact portion according to a second exemplary embodiment.

As illustrated in FIG. 4, the wiper blade 183 is in a form in which one linear, plate-like wiper blade 183 is bent in an arcuate shape from a center portion in a longitudinal direction. More specifically, the form has a convexly curved form toward the movement direction St.

The wiper blade 183 has a first contact portion 183*a* and a second contact portion 183*b* with the top portion T0 of the above center portion as a boundary. The first contact portion 183*a* and the second contact portion 183*b* contact the front surface 33*a* of the transporting belt 33 and are inclined in mutually different directions with respect to the movement direction St of the transporting belt 33. In the present exemplary embodiment, the top portion T0 is located at the uppermost stream, and the first contact portion 183*a* and the second contact portion 183*b* are disposed downstream of the top portion T0 toward different directions respectively in the movement direction St, with the top portion T0 as a starting point.

Further, when a direction orthogonal to the movement direction St of the transporting belt 33 and along the transporting belt 33 is an orthogonal direction (direction along the X-axis), the range D1 provided with the first contact portion 183*a* and the second contact portion 183*b* in the orthogonal direction is wider than the width dimension D0 of the transporting belt 33 in the orthogonal direction, and the gap G between the first contact portion 183*a* and the second contact portion 183*b* in the orthogonal direction increases in the movement direction St. In other words, the first contact portion 183*a* and the second contact portion 183*b* are disposed so as to be separated from each other while proceeding downstream of the top portion T0 in the movement direction St, starting from the top portion T0. In the present exemplary embodiment, the first contact portion 183*a* is disposed in the +X direction with respect to the second contact portion 183*b*. The first contact portion 183*a* and the second contact portion 183*b* are substantially symmetrical with respect to the center line Bc.

In the first contact portion 183*a*, the top portion T0 is located upstream in the movement direction St, and an end portion 183*ae* is located downstream. In the first contact portion 183*a* disposed at an inclination with respect to the movement direction St in a curved state, a difference in tension acting on the transporting belt 33 occurs between the central region Tc1 of the transporting belt 33 near the top portion T0 and the end portion region Te1 of the transporting belt 33 near the one end 33*e*1. Specifically, as in the first exemplary embodiment, the tension is greater in the central region Tc1 than in the end portion region Te1.

On the other hand, in the second contact portion 183*b*, the top portion T0 is located upstream in the movement direction St, and an end portion 183*be* is located downstream. In the second contact portion 183*b* disposed at an inclination with respect to the movement direction St in a curved state, similar to the above, a difference in tension acting on the transporting belt 33 occurs between the central region Tc2 of the transporting belt 33 near the top portion T0 and the end portion region Te2 of the transporting belt 33 near the other end 33*e*2. Specifically, similar to the first exemplary embodiment, the tension is higher in the central region Tc2 near the top portion T0 than in the end portion region Te2 near the end portion 183*be*.

Then, a pressing pressure acting from the end portion region Te1 toward the central region Tc1 in the first contact portion 183*a* and a pressing pressure acting from the end portion region Te2 toward the central region Tc2 in the second contact portion 183*b* are balanced in a region of the top portion T0, in an ideal state in which the transporting belt 33 is not oblique. In other words, the tension difference in the first contact portion 183*a* and the tension difference in the second contact portion 183*b* are equivalent, and obliquity of the transporting belt 33 can be suppressed.

Further, for example, when the wiper blade 183 is brought into contact with the transporting belt 33 in a state of being oblique clockwise or counterclockwise in FIG. 4, a size of a contact region of the first contact portion 183*a* with the transporting belt 33 differs from a size of a contact region of the second contact portion 183*b* with the transporting belt 33. In this state, the tension difference in the first contact portion 183*a* and the tension difference in the second contact portion 183*b* are different, thus the pressing pressure by the first contact portion 183*a* and the pressing pressure by the second contact portion 183*b* do not balance in the region of the top portion T0. As a result, the transporting belt 33 moves in a direction where the pressing pressure acts more greatly. Finally, the transporting belt 33 moves to a position where the pressing pressure in the first contact portion 183*a* and the pressing pressure in the second contact portion 183*b* are equivalent. That is, contact of the wiper blade 183 can correct the transporting belt 33 in an oblique condition to the ideal state.

3. Third Exemplary Embodiment

Next, a third exemplary embodiment will be described.

Note that, a basic configuration of the recording device 100 is similar to that of the first exemplary embodiment, and thus descriptions thereof will be omitted, and a configuration different from that of the first exemplary embodiment, that is, a configuration of a wiper blade 283 as a contact portion will be described.

Figure 5:
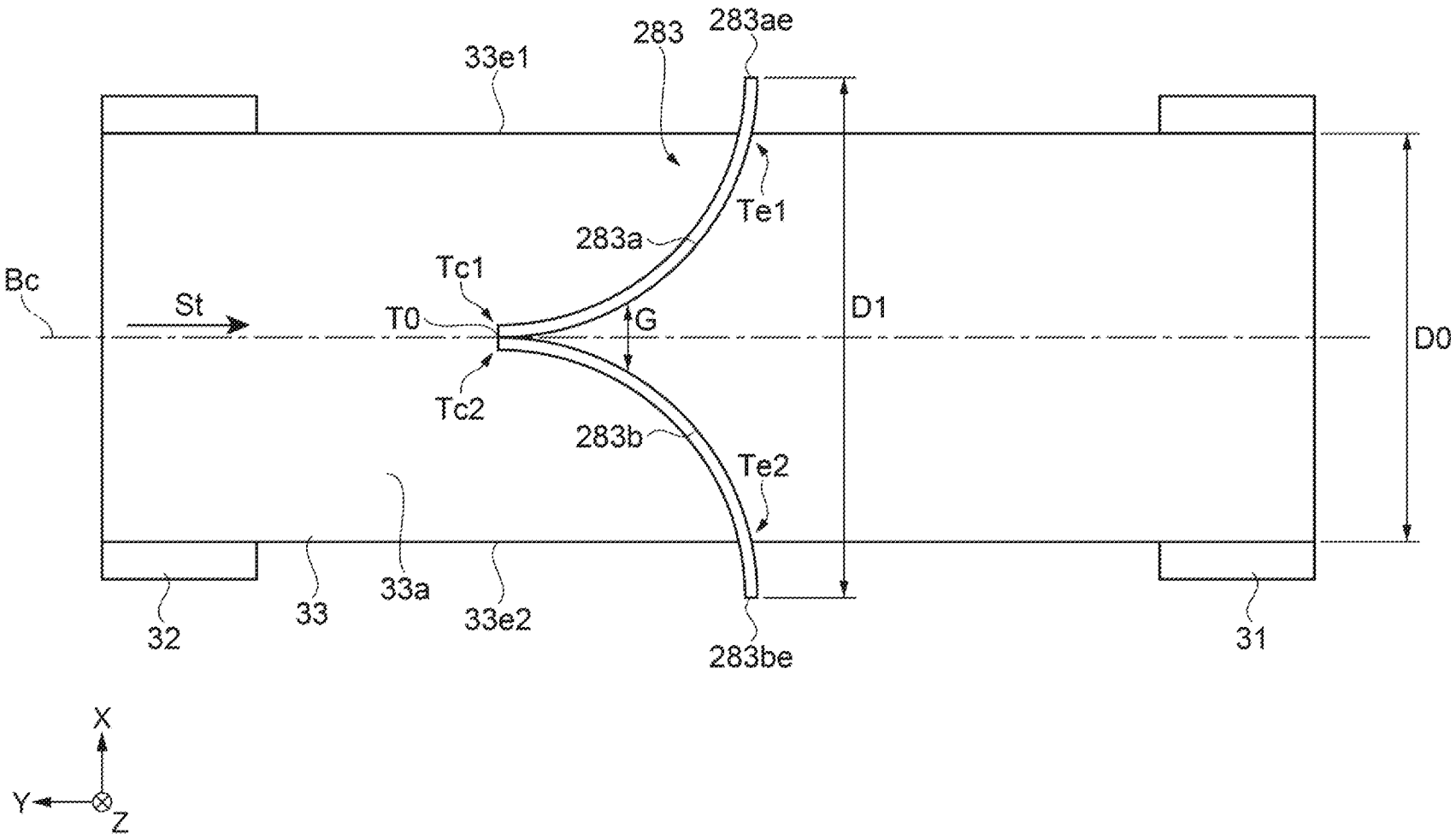
FIG. 5 is a plan view illustrating a configuration of a contact portion according to a third exemplary embodiment.

As illustrated in FIG. 5, the wiper blade 283 has a curved form in a state sharpened toward the movement direction St. The wiper blade 283 has a first contact portion 283*a* and a second contact portion 283*b* with the sharpened top portion T0 as a boundary.

The first contact portion 283*a* and the second contact portion 283*b* are in contact with the front surface 33*a* of the transporting belt 33 and are inclined in mutually different directions with respect to the movement direction St of the transporting belt 33. In the present exemplary embodiment, the top portion T0 is located at the uppermost stream, and the first contact portion 283*a* and the second contact portion 283*b* are disposed downstream of the top portion T0 toward different directions respectively in the movement direction St, with the top portion T0 as a starting point.

Further, when a direction orthogonal to the movement direction St of the transporting belt 33 and along the transporting belt 33 is an orthogonal direction (direction along the X-axis), the range D1 provided with the first contact portion 283*a* and the second contact portion 283*b* in the orthogonal direction is wider than the width dimension D0 of the transporting belt 33 in the orthogonal direction, and the gap G between the first contact portion 283*a* and the second contact portion 283*b* in the orthogonal direction increases in the movement direction St. In other words, the first contact portion 283*a* and the second contact portion 283*b* are disposed so as to be separated from each other while proceeding downstream of the top portion T0 in the movement direction St, starting from the top portion T0. In the present exemplary embodiment, the first contact portion 283*a* is disposed in the +X direction with respect to the second contact portion 283*b*. The first contact portion 283*a* and the second contact portion 283*b* are substantially symmetrical with respect to the center line Bc.

In the first contact portion 283*a*, the top portion T0 is located upstream in the movement direction St, and an end portion 283*ae* is located downstream. In the first contact portion 283*a* disposed at an inclination with respect to the movement direction St in a curved state, a difference in tension acting on the transporting belt 33 occurs between the central region Tc1 of the transporting belt 33 near the top portion T0 and the end portion region Te1 of the transporting belt 33 near the one end 33*e*1. Here, the one end 33*e*1 is an end portion of the transporting belt 33 on a side of the end portion 283*ae*, and is an end portion of the transporting belt 33 in the +X direction. Specifically, similar to the first exemplary embodiment, the tension is higher in the central region Tc1 near the top portion T0 than in the end portion region Te1 near the end portion 283*ae*.

On the other hand, in the second contact portion 283*b*, the top portion T0 is located upstream in the movement direction St, and an end portion 283*be* is located downstream. In the second contact portion 283*b* disposed at an inclination with respect to the movement direction St in a curved state, similar to the above, a difference in tension acting on the transporting belt 33 occurs between the central region Tc2 of the transporting belt 33 near the top portion T0 and the end portion region Te2 of the transporting belt 33 near the other end 33*e*2. Specifically, similar to the first exemplary embodiment, the tension is higher in the central region Tc2 near the top portion T0 than in the end portion region Te2 near the end portion 283*be*.

Then, a pressing pressure acting from the end portion region Te1 toward the central region Tc1 in the first contact portion 283*a* and a pressing pressure acting from the end portion region Te2 toward the central region Tc2 in the second contact portion 283*b* are balanced in a region of the top portion T0, in an ideal state in which the transporting belt 33 is not oblique. In other words, the tension difference in the first contact portion 283*a* and the tension difference in the second contact portion 283*b* are equivalent, and obliquity of the transporting belt 33 can be suppressed.

Further, for example, when the wiper blade 283 is brought into contact with the transporting belt 33 in a state of being oblique clockwise or counterclockwise in FIG. 5, a size of a contact region of the first contact portion 283*a* with the transporting belt 33 differs from a size of a contact region of the second contact portion 283*b* with the transporting belt 33. In this state, the tension difference in the first contact portion 283*a* and the tension difference in the second contact portion 283*b* are different, thus the pressing pressure by the first contact portion 283*a* and the pressing pressure by the second contact portion 283*b* do not balance in the region of the top portion T0. As a result, the transporting belt 33 moves in a direction where the pressing pressure acts more greatly. Finally, the transporting belt 33 moves to a position where the pressing pressure in the first contact portion 283*a* and the pressing pressure in the second contact portion 283*b* are equivalent. That is, contact of the wiper blade 283 can correct the transporting belt 33 in an oblique condition to the ideal state.

4. Fourth Exemplary Embodiment

Next, a fourth exemplary embodiment will be described.

Note that, a basic configuration of the recording device 100 is similar to that of the first exemplary embodiment, and thus descriptions thereof will be omitted, and a configuration different from that of the first exemplary embodiment, that is, a configuration of a wiper blade 383 as a contact portion will be described.

Figure 6:
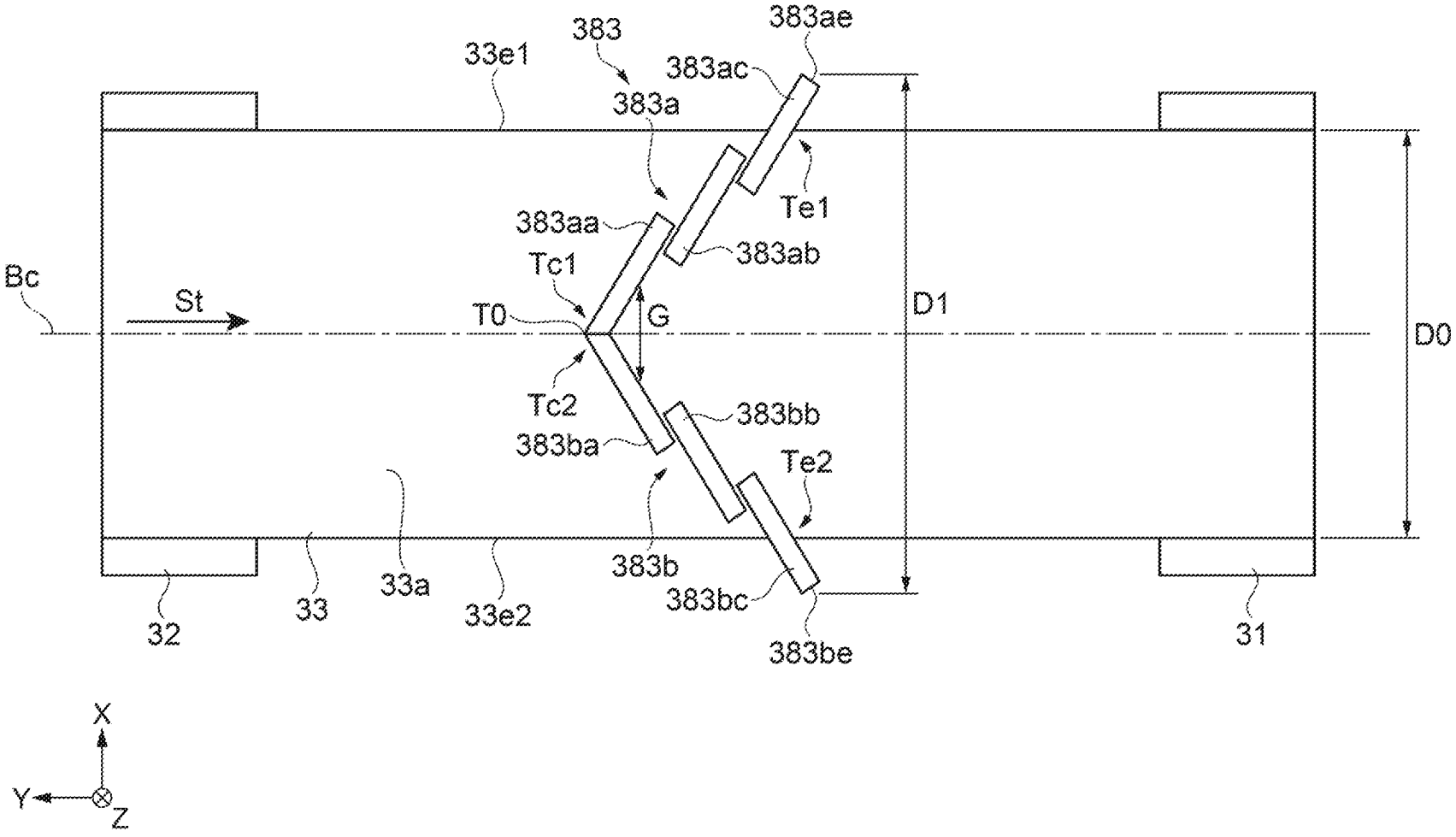
FIG. 6 is a plan view illustrating a configuration of a contact portion according to a fourth exemplary embodiment.

As illustrated in FIG. 6, the wiper blade 383 is constituted by a plurality of first contact portions 383*a* and a plurality of second contact portions 383*b*, with the top portion T0 as a boundary. In the present exemplary embodiment, the first contact portions 383*a* are constituted by three split contact portions 383*aa*, 383*ab*, and 383*ac*, and the split contact portion 383*aa*, the split contact portion 383*ab*, and the split contact portion 383*ac* are disposed facing downstream from upstream in this order in the movement direction St. The split contact portions 383*aa*, 383*ab*, and 383*ac* are disposed inclined in an identical direction with respect to the movement direction St. The split contact portions 383*aa*, 383*ab*, and 383*ac* are disposed so as to partially overlap in the movement direction St.

Similarly, the second contact portions 383*b* are constituted by three split contact portions 383*ba*, 383*bb*, and 383*bc*, and the split contact portion 383*ba*, the split contact portion 383*bb*, and the split contact portion 383*bc* are disposed facing downstream from upstream in this order in the movement direction St. The split contact portions 383*ba*, 383*bb*, and 383*bc* are disposed inclined in an identical direction with respect to the movement direction St. The split contact portions 383*ba*, 383*bb*, and 383*bc* are disposed so as to partially overlap with respect to the movement direction St.

The first contact portions 383*a* (split contact portions 383*aa*, 383*ab*, and 383*ac*) and the second contact portions 383*b* (split contact portions 383*ba*, 383*bb*, and 383*bc*) contact the front surface 33*a* of the transporting belt 33 and are inclined in mutually different directions with respect to the movement direction St of the transporting belt 33.

Further, when a direction orthogonal to the movement direction St of the transporting belt 33 and along the transporting belt 33 is an orthogonal direction (direction along the X-axis), the range D1 provided with the first contact portion 383*a* and the second contact portion 383*b* in the orthogonal direction is wider than the width dimension D0 of the transporting belt 33 in the orthogonal direction, and the gap G between the first contact portion 383*a* and the second contact portion 383*b* in the orthogonal direction increases in stages in the movement direction St. In other words, the first contact portion 383*a* and the second contact portion 383*b* are disposed so as to be separated from each other while proceeding downstream of the top portion T0 in the movement direction St, starting from the top portion T0. In the present exemplary embodiment, the first contact portion 383*a* is disposed in the +X direction with respect to the second contact portion 383*b*. The first contact portion 383*a* and the second contact portion 383*b* are substantially symmetrical with respect to the center line Bc.

In the first contact portion 383*a*, the top section T0 of the split contact portion 383*aa* is located upstream in the movement direction St, and an end portion 383*ae* of the split contact portion 383*ac* is located at the lowermost stream. In the first contact portion 383*a* disposed at an inclination with respect to the movement direction St, a difference in tension acting on the transporting belt 33 occurs between the central region Tc1 of the transporting belt 33 near the top portion T0 and the end portion region Te1 of the transporting belt 33 near the one end 33*e*1. Here, the one end 33*e*1 is an end portion of the transporting belt 33 on a side of the end portion 383*ae*, and is an end portion of the transporting belt 33 in the +X direction. Specifically, as in the first exemplary embodiment, the tension is greater in the central region Tc1 than in the end portion region Te1.

On the other hand, in the second contact portion 383*b*, the top section T0 of the split contact portion 383*ba* is located upstream in the movement direction St, and an end portion 383*be* of the split contact portion 383*bc* is located at the lowermost stream. In the second contact portion 383*b* disposed at an inclination with respect to the movement direction St, a difference in tension on the transporting belt 33 occurs between the central region Tc2 of the transporting belt 33 near the top portion T0 and the end portion region Te2 of the transporting belt 33 near the other end 33*e*2. Here, the other end 33*e*2 is an end portion of the transporting belt 33 on a side of the end portion 383*be*, and is an end portion of the transporting belt 33 in the −X direction. Specifically, as in the first exemplary embodiment, the tension is greater in the central region Tc2 than in the end portion region Te2.

Then, a pressing pressure acting from the end portion region Te1 toward the central region Tc1 in the first contact portion 383*a* and a pressing pressure acting from the end portion region Te2 toward the central region Tc2 in the second contact portion 383*b* are balanced in a region of the top portion T0, in an ideal state in which the transporting belt 33 is not oblique. Accordingly, the tension difference in the first contact portion 383*a* and the tension difference in the second contact portion 383*b* are equivalent, and obliquity of the transporting belt 33 can be suppressed.

Further, for example, when the wiper blade 383 is brought into contact with the transporting belt 33 in a state of being oblique clockwise or counterclockwise in FIG. 6, a size of a contact region of the first contact portion 383*a* with the transporting belt 33 differs from a size of a contact region of the second contact portion 383*b* with the transporting belt 33. In this state, the tension difference in the first contact portion 383*a* and the tension difference in the second contact portion 383*b* are different, thus the pressing pressure by the first contact portion 383*a* and the pressing pressure by the second contact portion 383*b* do not balance in the region of the top portion T0. As a result, the transporting belt 33 moves in a direction where the pressing pressure acts more greatly. Finally, the transporting belt 33 moves to a position where the pressing pressure in the first contact portion 383*a* and the pressing pressure in the second contact portion 383*b* are equivalent. That is, contact of the wiper blade 383 can correct the transporting belt 33 in an oblique condition to the ideal state.

5. Fifth Exemplary Embodiment

Next, a fifth exemplary embodiment will be described.

Note that, a basic configuration of the recording device 100 is similar to that of the first exemplary embodiment, and thus descriptions thereof will be omitted, and a configuration different from that of the first exemplary embodiment, that is, a configuration of a rotary brush 483 as a contact portion in place of the wiper blade 83 will be described.

Figure 7:
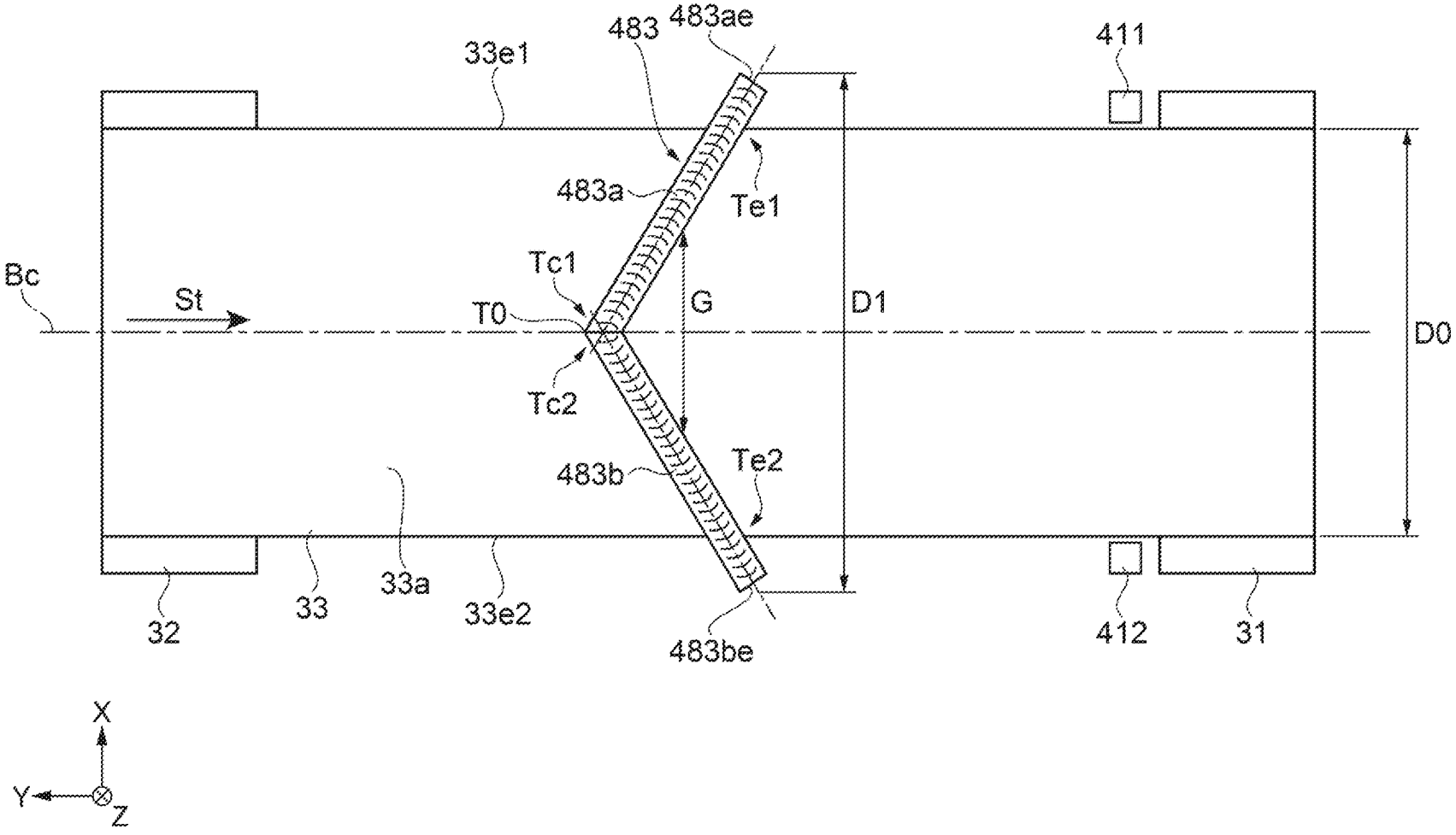
FIG. 7 is a plan view illustrating a configuration of a contact portion according to a fifth exemplary embodiment.

As illustrated in FIG. 7, the rotary brush 483 includes a first contact portion 483*a* and a second contact portion 483*b* that contact the front surface 33*a* of the transporting belt 33, and are inclined in mutually different directions with respect to the movement direction St of the transporting belt 33.

Each of the first contact portion 483*a* and the second contact portion 483*b* has a rotary shaft and a fiber body such as rigid nylon attached to the rotary shaft. The rotary shafts are rotated by driving of first and second driving portions 408*a* and 408*b* (see FIG. 8), such as motors, respectively. Then, the fiber body rotates about the rotary shaft in accordance with the rotation of the rotary shaft.

The rotary brush 483 rotates generating a speed difference from a speed in the movement direction St of the transporting belt 33. That is, a rotational movement of the rotary brush 483 may increase a sliding load on the transporting belt 33. The speed difference between the transporting belt 33 and the rotary brush 483 results in an increase in the sliding load between the transporting belt 33 and the rotary brush 483. Because the sliding load is a driving force that suppresses obliquity of the transporting belt 33, obliquity of the transporting belt 33 can be suppressed. In the present exemplary embodiment, when an end portion 483*ae* of the first contact portion 483*a* is viewed from a direction along the rotary shaft of the first contact portion 483*a*, the first contact portion 483*a* is rotated so as to rotate counterclockwise. Further, when an end portion 483*be* of the second contact portion 483*b* is viewed from a direction of the rotary shaft of the second contact portion 483*b*, the second contact portion 483*b* is rotated so as to rotate clockwise.

The rotary brush 483 has the first contact portion 483*a* and the second contact portion 483*b* with the top portion T0 as a boundary. The first contact portion 483*a* and the second contact portion 483*b* are in contact with the front surface 33*a* of the transporting belt 33 and are inclined in mutually different directions with respect to the movement direction St of the transporting belt 33. In the present exemplary embodiment, the top portion T0 is located at the uppermost stream, and the first contact portion 483*a* and the second contact portion 483*b* are disposed downstream of the top portion T0 toward different directions respectively in the movement direction St, with the top portion T0 as a starting point.

Further, when a direction orthogonal to the movement direction St of the transporting belt 33 and along the transporting belt 33 is an orthogonal direction (direction along the X-axis), the range D1 provided with the first contact portion 483*a* and the second contact portion 483*b* in the orthogonal direction is wider than the width dimension D0 of the transporting belt 33 in the orthogonal direction, and the gap G between the first contact portion 483*a* and the second contact portion 483*b* in the orthogonal direction increases in the movement direction St. In other words, the first contact portion 483*a* and the second contact portion 483*b* are disposed so as to be separated from each other while proceeding downstream of the top portion T0 in the movement direction St, starting from the top portion T0. In the present exemplary embodiment, the first contact portion 483*a* is disposed in the +X direction with respect to the second contact portion 483*b*. The first contact portion 483*a* and the second contact portion 483*b* are substantially symmetrical with respect to the center line Bc. Note that, an angle formed by each of the first contact portion 483*a* and the second contact portion 483*b* and the center line Bc is set to be a range in which each rotary shaft can be driven to rotate along with an advance of the transporting belt 33 in the movement direction St.

In the first contact portion 483*a*, the top portion T0 is located upstream in the movement direction St, and the end portion 483*ae* is located downstream. In the first contact portion 483*a* disposed at an inclination with respect to the movement direction St, a difference in tension acting on the transporting belt 33 occurs between the central region Tc1 of the transporting belt 33 near the top portion T0 and the end portion region Te1 of the transporting belt 33 near the one end 33*e*1. Here, the one end 33*e*1 is an end portion of the transporting belt 33 on a side of the end portion 483*ae*, and is an end portion of the transporting belt 33 in the +X direction. Specifically, as in the first exemplary embodiment, the tension is greater in the central region Tc1 than in the end portion region Te1.

On the other hand, in the second contact portion 483*b*, the top portion T0 is located upstream in the movement direction St, and the end portion 483*be* is located downstream. In the second contact portion 483*b* disposed at an inclination with respect to the movement direction St, similar to the above, a tension difference acting on the transporting belt 33 occurs between the end portion region Te2 of the transporting belt 33 near the other end 33*e*2 and the central region Tc2 of the transporting belt 33 near the top portion T0. Here, the other end 33*e*2 is an end portion of the transporting belt 33 on a side of the end portion 483*be*, and is an end portion of the transporting belt 33 in the −X direction. Specifically, as in the first exemplary embodiment, the tension is greater in the central region Tc2 than in the end portion region Te2.

Then, a pressing pressure acting from the end portion region Te1 toward the central region Tc1 in the first contact portion 483*a* and a pressing pressure acting from the end portion region Te2 toward the central region Tc2 in the second contact portion 483*b* are balanced in a region of the top portion T0, in an ideal state in which the transporting belt 33 is not oblique. Accordingly, the tension difference in the first contact portion 483*a* and the tension difference in the second contact portion 483*b* are equivalent, and obliquity of the transporting belt 33 can be suppressed.

Further, for example, when the rotary brush 483 is brought into contact with the transporting belt 33 in a state of being oblique clockwise or counterclockwise in FIG. 7, a size of a contact region of the first contact portion 483*a* with the transporting belt 33 differs from a size of a contact region of the second contact portion 483*b* with the transporting belt 33. In this state, the tension difference in the first contact portion 483*a* and the tension difference in the second contact portion 483*b* are different, thus the pressing pressure by the first contact portion 483*a* and the pressing pressure by the second contact portion 483*b* do not balance in the region of the top portion T0. As a result, the transporting belt 33 moves in a direction where the pressing pressure acts more greatly. Finally, the transporting belt 33 moves to a position where the pressing pressure in the first contact portion 483*a* and the pressing pressure in the second contact portion 483*b* are equivalent. That is, contact of the rotary brush 483 can correct the transporting belt 33 in an oblique condition to the ideal state.

Here, for example, a case where a state of the sliding load of the rotary brush 483 with respect to the transporting belt 33 changes, or a case where obliquity of the transporting belt 33 cannot be eliminated only with a layout of the rotary brush 483 may occur.

Figure 8:
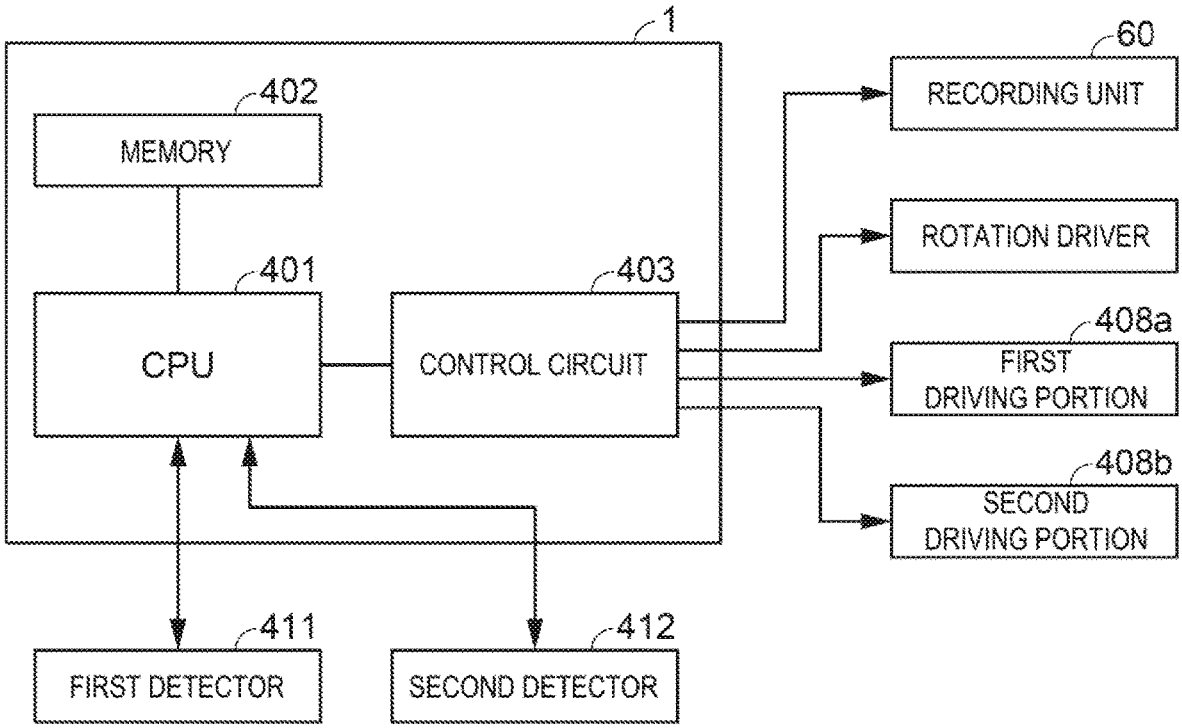
FIG. 8 is a block view illustrating an electrical configuration of a recording device according to the fifth exemplary embodiment.

Therefore, in the present exemplary embodiment, as illustrated in FIG. 8, when determining that movement of the transporting belt 33 in the orthogonal direction is not eliminated, the control unit 1 variably controls rotational torque applied to the rotary brush 483. As a result, obliquity of the transporting belt 33 can be reduced, even when a case occurs where the obliquity cannot be eliminated only with the change in the sliding load state of the rotary brush 483, the layout of the rotary brush 483, or the like.

As illustrated in FIG. 8, the recording device 100 includes the control unit 1 that comprehensively controls components of the recording device 100, and first and second detectors 411 and 412 controlled by the control unit 1. The first and second detectors 411 and 412 detect obliquity of the transporting belt 33. For example, the first and second detectors 411 and 412 are each a photo-interrupter, and include a light emitting unit that emits light and a light receiving unit that receives light emitted from the light emitting unit. For example, as a light emitting element of the light emitting unit, an LED (Light Emitting Diode) light emitting element, a laser light emitting element or the like are applied. In addition, the light receiving unit is configured by a phototransistor, a photo IC and the like. Then, a change in light receiving amount between the light emitting unit and the light receiving unit is converted into an electrical signal and output as detection data. In other words, when there is no light blocking between the light emitting unit and the light receiving unit, the first and second detectors 411 and 412 indicate an ON state. On the other hand, when there is light blocking between the light emitting unit and the light receiving unit by the transporting belt 33, the first and second detectors 411 and 412 indicate an OFF state. The control unit 1 determines presence or absence of occurrence of obliquity of the transporting belt 33, based on the detection data of the first and second detectors 411 and 412, and controls the first and second driving portions 408*a* and 408*b*.

As illustrated in FIG. 7, the first detector 411 is disposed downstream in the movement direction St of the transporting belt 33, and is disposed at a position in the +X direction with respect to the one end 33*e*1 in the +X direction of the transporting belt 33. The second detector 412 is disposed downstream in the movement direction St of the transporting belt 33, and is disposed at a position in the −X direction with respect to the other end 33*e*2 in the −X direction of the transporting belt 33. The first detector 411 and the second detector 412 are disposed at opposing positions with the transporting belt 33 interposed therebetween. Note that, the respective positions at which the first and second detectors 411 and 412 are disposed are not particularly limited as long as obliquity of the transporting belt 33 can be detected at the positions.

The control unit 1 includes an CPU 401, a memory 402, and a control circuit 403. The CPU 401 is an arithmetic processing device. The memory 402 is a storage device that secures a region for storing a program for the CPU 401, a work region, or the like, and has a storage element such as a RAM, an EEPROM, or the like. The CPU 401 controls each mechanism such as the recording unit 60, the first and second driving portions 408*a*, 408*b*, each rotation driver, or the like, via the control circuit 403 in accordance with the program stored in the memory 402.

Next, a control method of the recording device 100 according to the present exemplary embodiment will be described. Specifically, a control method for suppressing obliquity of the transporting belt 33 will be described.

Figure 9:
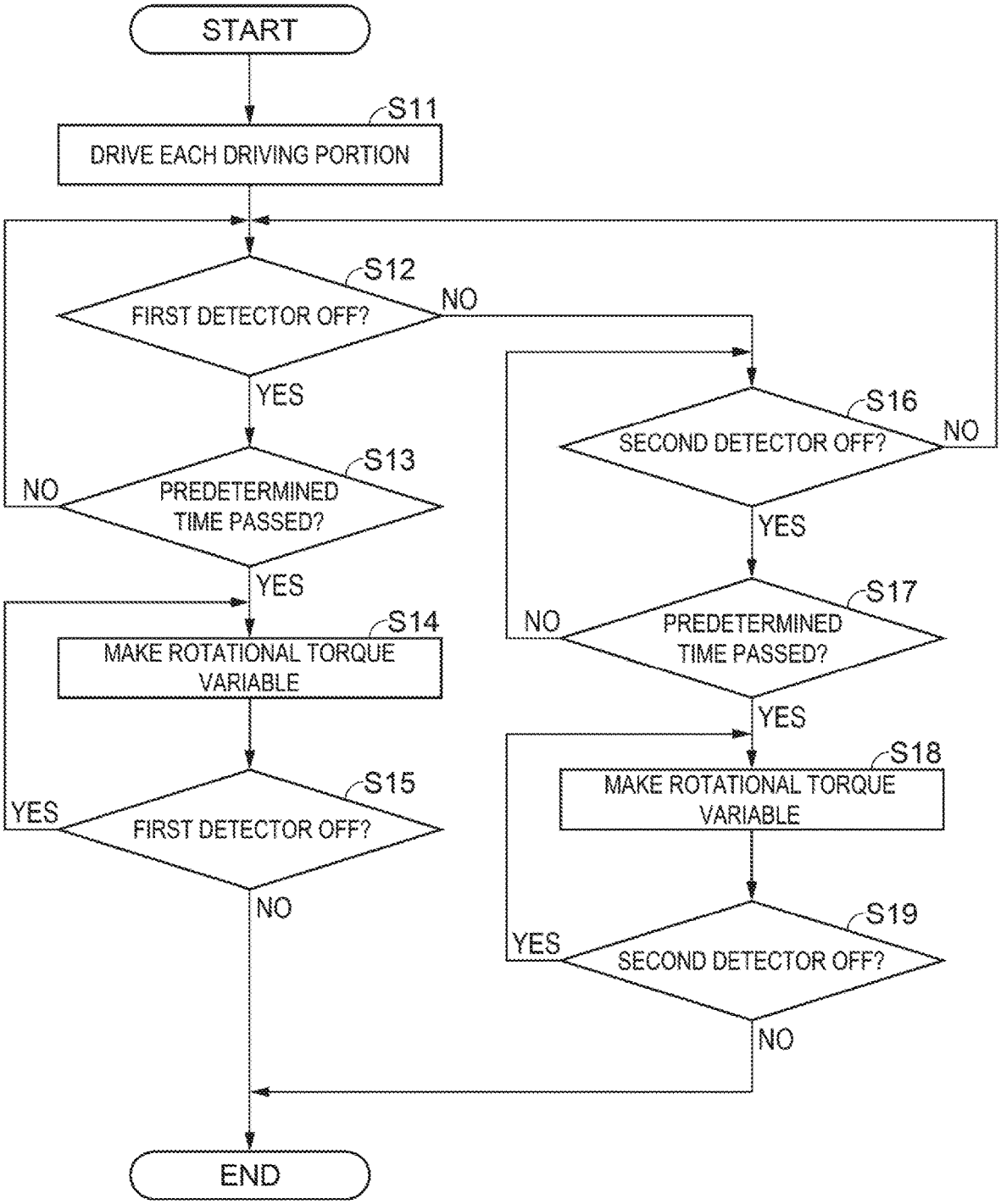
FIG. 9 is a flow chart illustrating a control method for the recording device according to the fifth exemplary embodiment.

As illustrated in FIG. 9, in step S11, the control unit 1 drives each driving portion. Specifically, the transporting belt 33 is moved in the movement direction St. Additionally, the first and second contact portions 483*a* and 483*b* are rotated and brought into contact with the transporting belt 33. Additionally, the first and second detectors 411 and 412 are driven.

Next, in step S12, the control unit 1 determines whether the first detector 411 is OFF or not based on detection data of the first detector 411. When the control unit 1 determines that the first detector 411 is OFF (YES), the processing transits to step S13, and when the control unit 1 determines that the first detector 411 is not OFF (is ON) (NO), the processing transits to step S16. In other words, when the first detector 411 is OFF, it is determined that the transporting belt 33 is oblique to a side of the +X direction. On the other hand, when the first detector 411 is not OFF, it is determined that there is no obliquity to the side of the +X direction of the transporting belt 33.

When the processing transits to step S13, the control unit 1 determines whether the OFF state of the first detector 411 is passed for a predetermined time or not. The control unit 1 includes a timer function, and for example, determines whether the OFF state of the first detector 411 is passed for 5 seconds as the predetermined time or not. Then, when the predetermined time is passed (YES), the processing transits to step S14, and when the predetermined time is not passed (NO), the processing transits to step S12.

Here, the case where the predetermined time is passed (YES) is a case where a state where a downstream side of the transporting belt 33 is oblique in the +X direction is maintained. On the other hand, the case where the predetermined time is not passed (NO) is a case where the downstream side of the transporting belt 33 is temporarily oblique in the +X direction, but is corrected to an ideal state where there is no obliquity within the predetermined time.

When the processing transits to step S14, the control unit 1 makes rotational torque provided to the rotary brush 483 variable. Specifically, the number of rotations of the first driving portion 408*a* is increased. As a result, a rotational speed of the first contact portion 483*a* increases, and a sliding load on the transporting belt 33 increases. As a result, a pressing pressure toward a side of the top portion T0 in the first contact portion 483*a* increases, and the oblique transporting belt 33 is moved in the −X direction, and the obliquity can be corrected. Note that, control may be performed to reduce the number of rotations of the second driving portion 408*b*. Even in this way, the pressing pressure toward the side of the top portion T0 in the first contact portion 483*a* is relatively increased, thus it is possible to obtain a similar effect.

Here, the variable control of the rotational torque in step S14 is performed in accordance with a data table stored in the memory 402. In other words, after the rotational torque is made variable based on first data in the data table, the processing transits to step S15 to determine whether the first detector 411 is OFF in step S15 or not. Then, when the first detector 411 is not OFF (NO), the processing ends. In other words, it is indicated that the obliquity of the transporting belt 33 is eliminated by the first data.

On the other hand, when the first detector 411 is OFF (YES), the obliquity of the transporting belt 33 is not yet eliminated. In this case, the processing transits to step S14, the rotational torque is made variable based on second data in the data table. The second data is data that makes the number of rotations greater than the number of rotations of the first driving portion 408*a* corresponding to the first data. As a result, the pressing pressure toward the side of the top portion T0 in the first contact portion 483*a* further increases, and the transporting belt 33 can be moved in the −X direction. Thereafter, steps S14 and S15 are repeated, and when the first detector 411 is not OFF (NO) in step S15, the processing ends.

Additionally, when the processing transits from step S12 to step S16, the control unit 1 determines whether the second detector 412 is OFF or not based on detection data of the second detector 412. In other words, it is determined whether or not the transporting belt 33 is oblique in the −X direction. When the control unit 1 determines that the second detector 412 is OFF (YES), the processing transits to step S17, and when the control unit 1 determines that the second detector 412 is not OFF (is ON) (NO), the processing transits to step S12.

When the processing transits to step S17, the control unit 1 determines whether the OFF state of the second detector 412 is passed for a predetermined time or not. The control unit 1, for example, determines whether the OFF state of the second detector 412 is passed for 5 seconds as the predetermined time or not. Then, when the predetermined time is passed (YES), the processing transits to step S18, and when the predetermined time is not passed (NO), the processing transits to step S16.

Here, the case where the predetermined time is passed (YES) is a case where a state where the downstream side of the transporting belt 33 is oblique in the −X direction is maintained, and the case where the predetermined time is not passed (NO) is a case where the downstream side of the transporting belt 33 is temporarily oblique in the −X direction, but is corrected to the ideal state where there is no obliquity within the predetermined time.

When the processing transits to step S18, the control unit 1 makes the rotational torque provided to the rotary brush 483 variable. Specifically, the number of rotations of the second driving portion 408*b* is increased. As a result, a rotational speed of the second contact portion 483*b* increases, and the sliding load on the transporting belt 33 increases. As a result, a pressing pressure toward a side of the top portion T0 in the second contact portion 483*b* increases, and the transporting belt 33 is moved in the +X direction and the obliquity can be corrected. Note that, control may be performed to reduce the number of rotations of the first driving portion 408*a*. Even in this way, the pressing pressure toward the side of the top portion T0 of the second contact portion 483*b* is relatively increased, thus it is possible to obtain a similar effect.

Here, similar to the above, the variable control of the rotational torque in step S18 is performed in accordance with the data table stored in the memory 402. In other words, after the rotational torque is made variable based on first A data in the data table, the processing transits to step S19 to determine whether the second detector 412 is OFF or not in step S19. The first A data is data related to the number of rotations of the second driving portion 408*b* required to resolve obliquity, for example. Then, when the second detector 412 is not OFF (NO), the processing ends. In other words, it is indicated that the obliquity of the transporting belt 33 is eliminated by the first A data.

On the other hand, when the second detector 412 is OFF (YES), the obliquity of the transporting belt 33 is not yet eliminated. In this case, the processing proceeds to step S18, the rotational torque is made variable based on second A data in the data table. The second A data is data that makes the number of rotations greater than the number of rotations of the second driving portion 408*b* corresponding to the first A data. As a result, the pressing pressure toward the side of the top portion T0 in the second contact portion 483*b* further increases, and the transporting belt 33 can be moved in the +X direction. Thereafter, steps S18 and S19 are repeated, and, when the second detector 412 is not OFF (NO) in step S19, the processing ends. Note that, the first A data and the second A data are determined in advance by experiments, simulations, and the like. A plurality of data sets including the first A data and the second A data are a data table. In the above description, the first A data and the second A data have been described as data relating to the second driving portion 408*b*, but the data may be data related to the first driving portion 408*a*. Furthermore, the data table related to at least one of the first driving portion 408*a* and the second driving portion 408*b* may include an input current, an input voltage, and a torque limit value to the first driving portion 408*a* and the second driving portion 408*b* rather than the number of rotations.

As described above, according to the present exemplary embodiment, by using the rotary brush 483 as the contact portion, obliquity of the transporting belt 33 can be suppressed while improving the cleaning effect of the front surface 33*a* of the transporting belt 33.

Further, the speed difference between the transporting belt 33 and the rotary brush 483 results in an increase in the sliding load between the transporting belt 33 and the rotary brush 483. Because the sliding load is a driving force that suppresses obliquity, obliquity of the transporting belt 33 can be further suppressed.

In addition, even when obliquity cannot be eliminated by only the layout of the rotary brush 483, obliquity of the transporting belt 33 can be reduced by variably controlling the rotational torque of the rotary brush 483 (the first contact portion 483*a* and the second contact portion 483*b*).

In the present exemplary embodiment, the first contact portion 483*a* and the second contact portion 483*b* have been described as the rotary brushes, but the present exemplary embodiment is not limited thereto. For example, it is sufficient that at least one of the first contact portion 483*a* and the second contact portion 483*b* is a rotary brush. In this case, for example, another may be a wiper blade. Even with this configuration, similar effects can be obtained.

6. Sixth Exemplary Embodiment

Next, a sixth exemplary embodiment will be described.

Note that, a basic configuration of the recording device 100 is similar to that of the first exemplary embodiment, and thus descriptions thereof will be omitted, and a configuration different from that of the first exemplary embodiment, that is, a configuration of a wiper blade 583 as a contact portion will be described.

Figure 10:
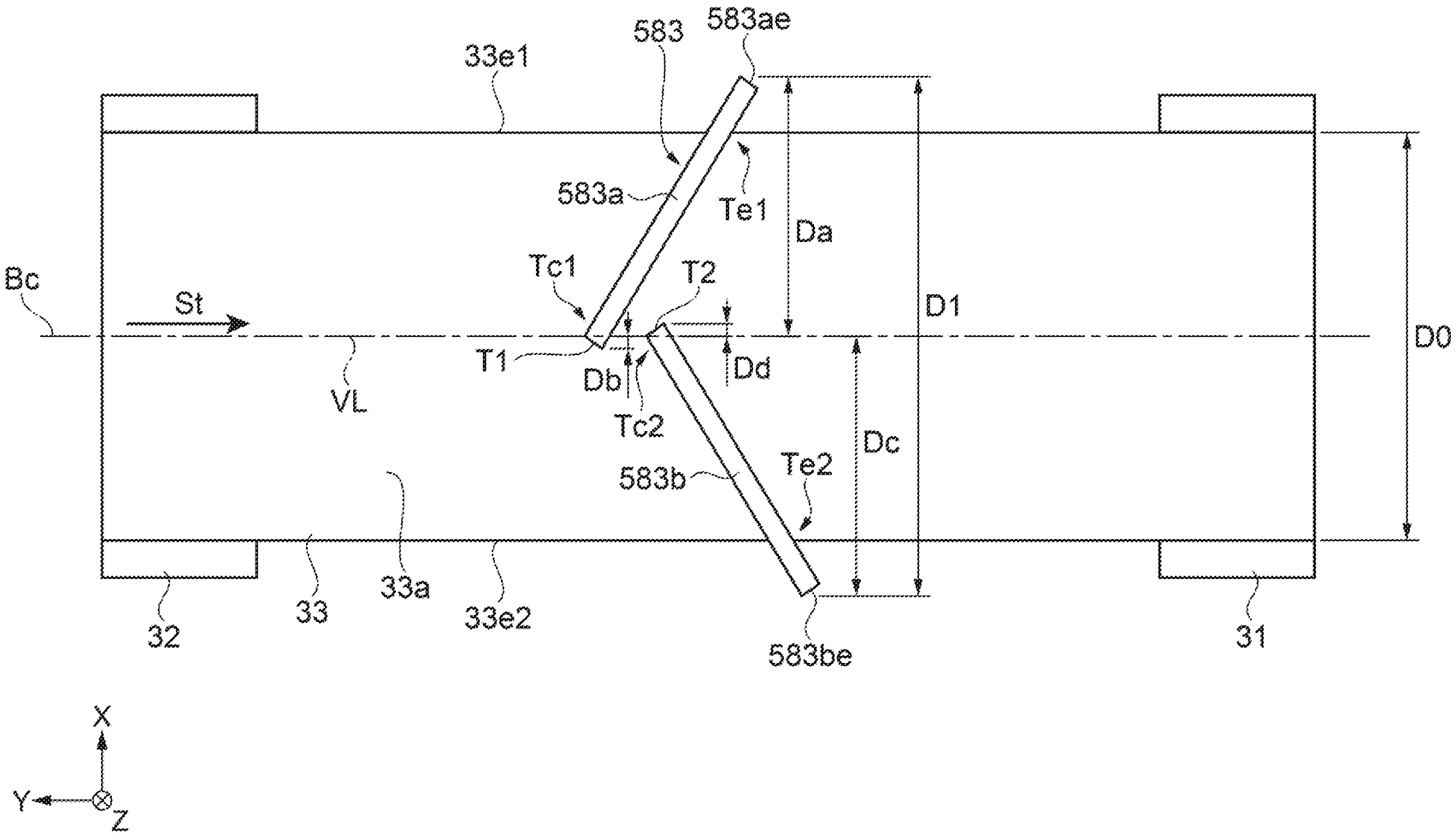
FIG. 10 is a plan view illustrating a configuration of a contact portion according to a sixth exemplary embodiment.

As illustrated in FIG. 10, the wiper blade 583 includes a first contact portion 583*a* that contacts the transporting belt 33 and is inclined in a first direction that intersects the movement direction St of the transporting belt 33, and a second contact portion 583*b* that contacts the transporting belt 33 and is inclined in a second direction that intersects the movement direction St and is different from the first direction.

The first contact portion 583*a* and the second contact portion 583*b* are both plate-like and have identical dimensions. The first contact portion 583*a* and the second contact portion 583*b* are disposed so as to be separated from each other. In the present exemplary embodiment, the first contact portion 583*a* is disposed upstream of the second contact portion 583*b* in the movement direction St.

A portion at the uppermost stream of the first contact portion 583*a* is a top portion T1, and an end portion 583*ae* of the first contact portion 583*a* is disposed facing downstream in the movement direction St. The top portion T1 is located approximately on the center line Bc. Additionally, a portion at the uppermost stream of the second contact portion 583*b* is a top portion T2, and an end portion 583*be* of the second contact portion 583*b* is disposed facing downstream in the movement direction St. The top T2 is located approximately on the center line Bc.

In addition, the range D1 provided with the first contact portion 583*a* and the second contact portion 583*b* in an orthogonal direction orthogonal to the movement direction St (direction along the X-axis) is wider than the width dimension D0 of the transporting belt 33 in the orthogonal direction.

Also, as illustrated in FIG. 10, a straight line, parallel to the movement direction St, and passing through a center of the width dimension D0 of the transporting belt 33 in the orthogonal direction is a virtual line VL, a distance Da in the orthogonal direction between a downstream end (end portion 583*ae*) of the first contact portion 583*a* in the movement direction St and the virtual line VL is greater than a distance Db in the orthogonal direction between an upstream end (top portion T1) of the first contact portion 583*a* in the movement direction St and the virtual line VL. In other words, the first contact portion 583*a* is disposed so as to be separated toward a side of the one end 33*e*1 while proceeding downstream of the top portion T1 in the movement direction St, starting from the top portion T1.

In addition, a distance Dc in the orthogonal direction between a downstream end (end portion 583*be*) of the second contact portion 583*b* in the movement direction St and the virtual line VL is greater than a distance Dd in the orthogonal direction between an upstream end (top portion T2) of the second contact portion 583*b* and the virtual line VL in the movement direction St. In other words, the second contact portion 583*b* is disposed so as to be separated toward a side of the other end 33*e*2 while proceeding downstream of the top portion T2 in the movement direction St, starting from the top portion T2.

Then, the distance Da in the first contact portion 583*a* and the distance Dc in the second contact portion 583*b* are equivalent, and the distance Db in the first contact portion 583*a* and the distance Dd in the second contact portion 583*b* are equivalent.

Note that, the movement direction of the transporting belt 33 of the present exemplary embodiment includes both concepts of the movement direction St in an ideal state in which no obliquity occurs, and the movement direction Sta when obliquity occurs. Accordingly, there are two cases of the virtual line VL as well, that is, an ideal state and an oblique state. In other words, the movement directions St, Sta, and the virtual line VL may also vary in accordance with obliquity. Furthermore, the virtual line VL passes between the first contact portion 583*a* and the second contact portion 583*b* in the orthogonal direction. When in the belt-rotated roller 31 and the belt-driving roller 32 around which the transporting belt 33 is wound, respective one ends and respective another ends of rotary shafts are aligned, the virtual line VL can also be considered a straight line joining respective center portions of the rollers 31 and 32.

Furthermore, when the movement direction St and the virtual line VL vary as described above, it is conceivable that one of the first contact portion 583*a* and the second contact portion 583*b* is parallel with the virtual line VL. However, in this case, because an effect of suppressing obliquity of the transporting belt 33 is not exhibited, even when the transporting belt 33 is oblique, an inclination angle of the first contact portion 583*a* and the second contact portion 583*b* with respect to the center line Bc may be set by pre-evaluating an amount of obliquity of the transporting belt 33, such that one of the first contact portion 583*a* and the second contact portion 583*b* is not parallel with the virtual line VL.

According to the present exemplary embodiment, even in the configuration in which the first contact portion 583*a* and the second contact portion 583*b* are disposed at respective positions separated in the movement direction St, obliquity of the transporting belt 33 can be reduced because a difference in tension between the end portion region Te1 and a vicinity of the top portion T1 in the first contact portion 583*a*, and a difference in tension between the end portion region Te2 and a vicinity of the top portion T2 in the second contact portion 583*b* are balanced.

7. Seventh Exemplary Embodiment

Next, a seventh exemplary embodiment will be described.

Note that, a basic configuration of the recording device 100 is similar to that of the first exemplary embodiment, and thus descriptions thereof will be omitted, and a configuration different from that of the first exemplary embodiment and the sixth exemplary embodiment, that is, a configuration of a wiper blade 683 as a contact portion will be described.

Figure 11:
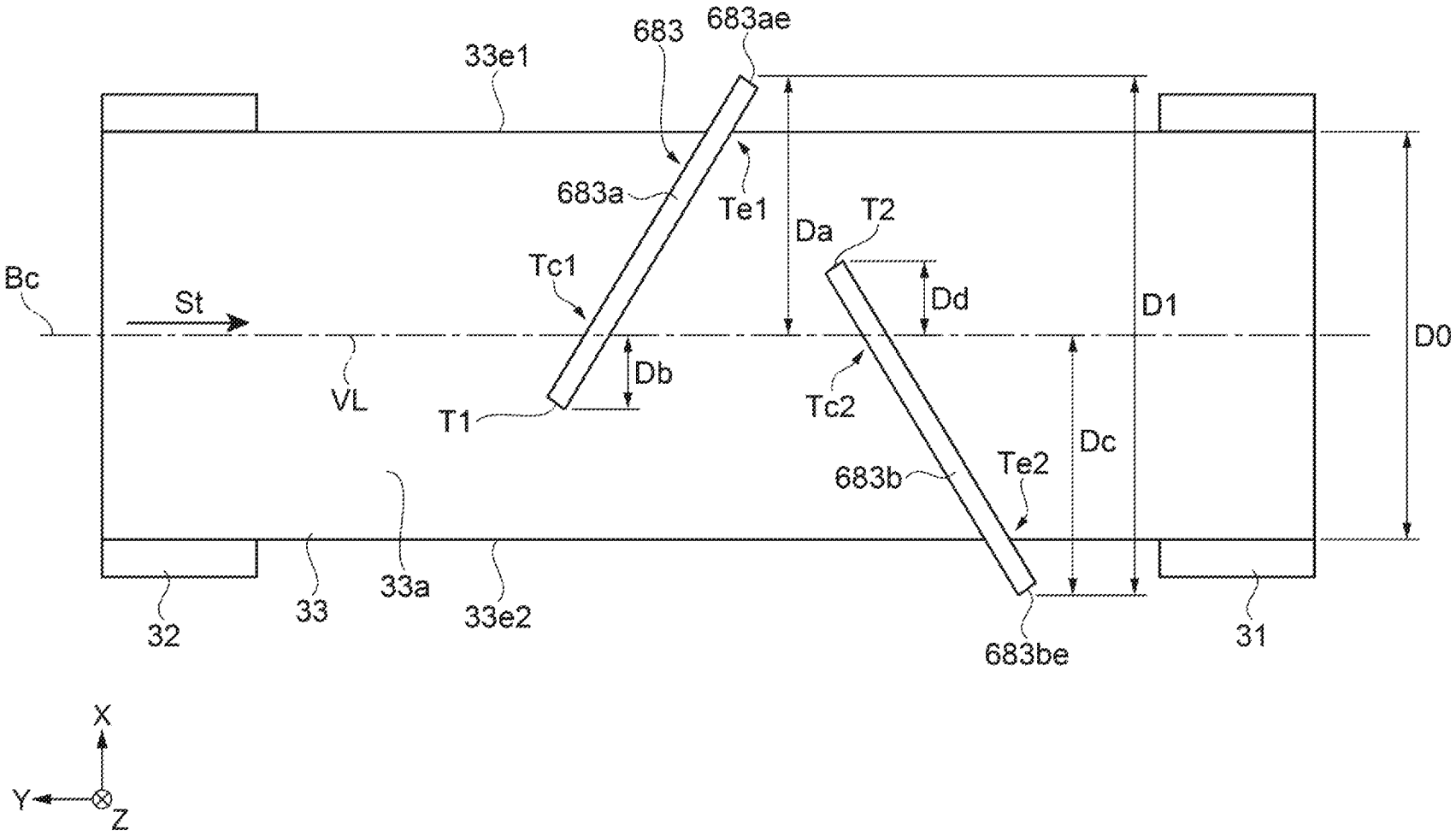
FIG. 11 is a plan view illustrating a configuration of a contact portion according to a seventh exemplary embodiment.

As illustrated in FIG. 11, a first contact portion 683*a* that contacts the transporting belt 33 and is inclined in a first direction that intersects the movement direction St of the transporting belt 33, and a second contact portion 683*b* that contacts the transporting belt 33 and is inclined in a second direction that intersects the movement direction St and is different from the first direction are included.

The first contact portion 683*a* and the second contact portion 683*b* are both plate-like and have identical dimensions. The first contact portion 683*a* and the second contact portion 683*b* are disposed so as to be separated from each other. Specifically, a separation distance is greater than a separation distance between the first contact portion 583*a* and the second contact portion 583*b* in the sixth exemplary embodiment. For example, when viewed along the X-axis, the first contact portion 583*a* and the second contact portion 583*b* in the sixth embodiment partially overlap, but the first contact portion 683*a* and the second contact portion 683*b* in the present exemplary embodiment are disposed separated so as not to overlap.

A portion at the uppermost stream of the first contact portion 683*a* is the top portion T1, and an end portion 683*ae* of the first contact portion 683*a* is disposed facing downstream in the movement direction St. The top portion T1 is located in the −X direction from the center line Bc. Additionally, a portion at the uppermost stream of the second contact portion 683*b* is the top portion T2, and an end portion 683*be* of the second contact portion 683*b* is disposed facing downstream in the movement direction St. The top portion T2 is located in the +X direction from the center line Bc.

Furthermore, the range D1 provided with the first contact portion 683*a* and the second contact portion 683*b* in the orthogonal direction orthogonal to the movement direction St is wider than the width dimension D0 of the transporting belt 33 in the orthogonal direction.

Also, as illustrated in FIG. 11, a straight line, parallel to the movement direction St, and passing through a center of the width dimension D0 of the transporting belt 33 in the orthogonal direction is the virtual line VL, the distance Da in the orthogonal direction between a downstream end (end portion 683*ae*) of the first contact portion 683*a* in the movement direction St and the virtual line VL is greater than the distance Db in the orthogonal direction between an upstream end (top portion T1) of the first contact portion 683*a* in the movement direction St and the virtual line VL. In other words, the first contact portion 683*a* is disposed so as to be separated toward a side of the one end 33*e*1 while proceeding downstream of the top portion T1 in the movement direction St, starting from the top portion T1.

In addition, the distance Dc in the orthogonal direction between a downstream end (end portion 683*be*) of the second contact portion 683*b* in the movement direction St and the virtual line VL is greater than the distance Dd in the orthogonal direction between an upstream end (top portion T2) of the second contact portion 683*b* in the movement direction St and the virtual line VL. In other words, the second contact portion 683*b* is disposed so as to be separated toward a side of the other end 33*e*2 while proceeding downstream of the top portion T2 in the movement direction St, starting from the top portion T2.

Then, the distance Da in the first contact portion 683*a* and the distance Dc in the second contact portion 683*b* are equivalent, and the distance Db in the first contact portion 683*a* and the distance Dd in the second contact portion 683*b* are equivalent.

Note that, the definitions of the movement direction St and the virtual line VL in the present exemplary embodiment are the same as in the sixth embodiment.

According to the present exemplary embodiments, the following advantages can be obtained.

8. Eighth Exemplary Embodiment

Next, an eighth exemplary embodiment will be described.

Figure 12:
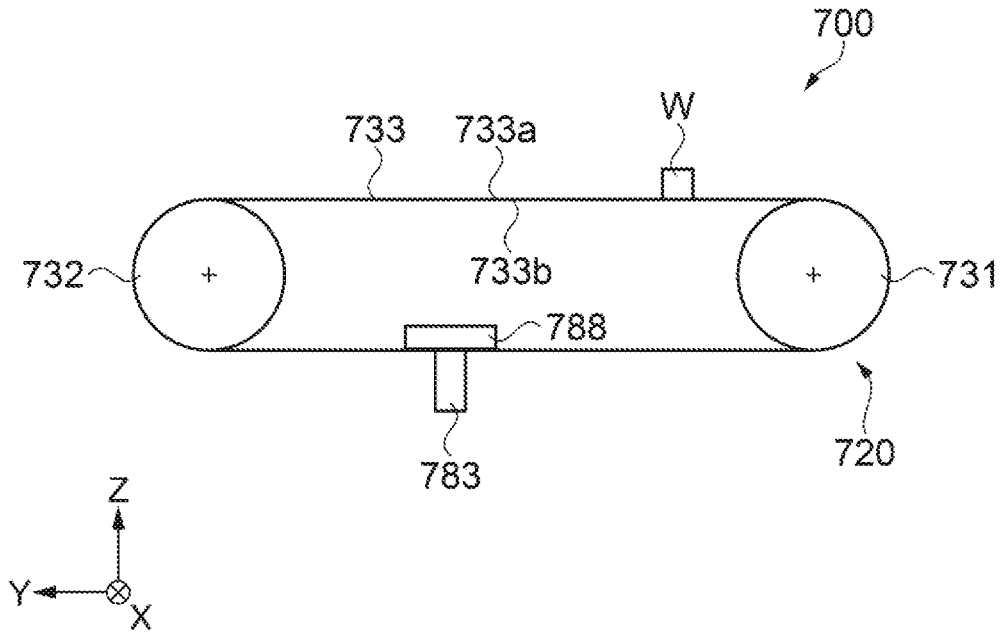
FIG. 12 is a schematic view illustrating a configuration of a transport device according to an eighth exemplary embodiment.

FIG. 12 is a schematic view illustrating a configuration of a transport device 700.

As illustrated in FIG. 12, the transport device 700 includes an object transport unit 720, and a wiper blade 783 as a contact portion.

The object transport unit 720 transports various objects W in a transport direction (+Y direction). The object transport unit 720 includes a transporting belt 733, a belt-rotated roller 731, and a belt-driving roller 732. The object W is, for example, an article such as an electronic component or a food product. The object W to be transported is, for example, picked up on the transporting belt 733 or further transported to another path from the belt-driving roller 732 downstream in the transport direction.

The transporting belt 733 has a belt shape including both end portions coupled to each other and is formed in an endless manner, and the transporting belt 733 is hung between the belt-rotated roller 731 and the belt-driving roller 732. The transporting belt 733 is held in a state where a predetermined tension is applied thereto. The object W is supported by a front surface 733*a* as an outer circumferential surface of the transporting belt 733.

The belt-rotated roller 731 and the belt-driving roller 732 are provided inside the transporting belt 733, and support an inner circumferential surface 733*b* of the transporting belt 733. The belt-driving roller 732 includes a rotation driver for rotationally driving the belt-driving roller 732. The belt-driving roller 732 is rotationally driven, and the transporting belt 733 rotationally moves, thus the belt-rotated roller 731 is driven to rotate. As a result, the object W supported by the transporting belt 733 is transported in the transport direction.

The wiper blade 783 has a plate shape and is formed of an elastic body such as rubber. The wiper blade 783 is disposed in contact with the transporting belt 733. In the present exemplary embodiment, the wiper blade 783 is disposed between the belt-driving roller 732 and the belt-rotated roller 731, is disposed below the transporting belt 733, and contacts the front surface 733*a* of the transporting belt 733. In addition, a receptacle 788 that receives a load of the wiper blade 783 via the transporting belt 733 is disposed. As a result, the load applied to the transporting belt 733 from the wiper blade 783 is held constant.

Figure 13:
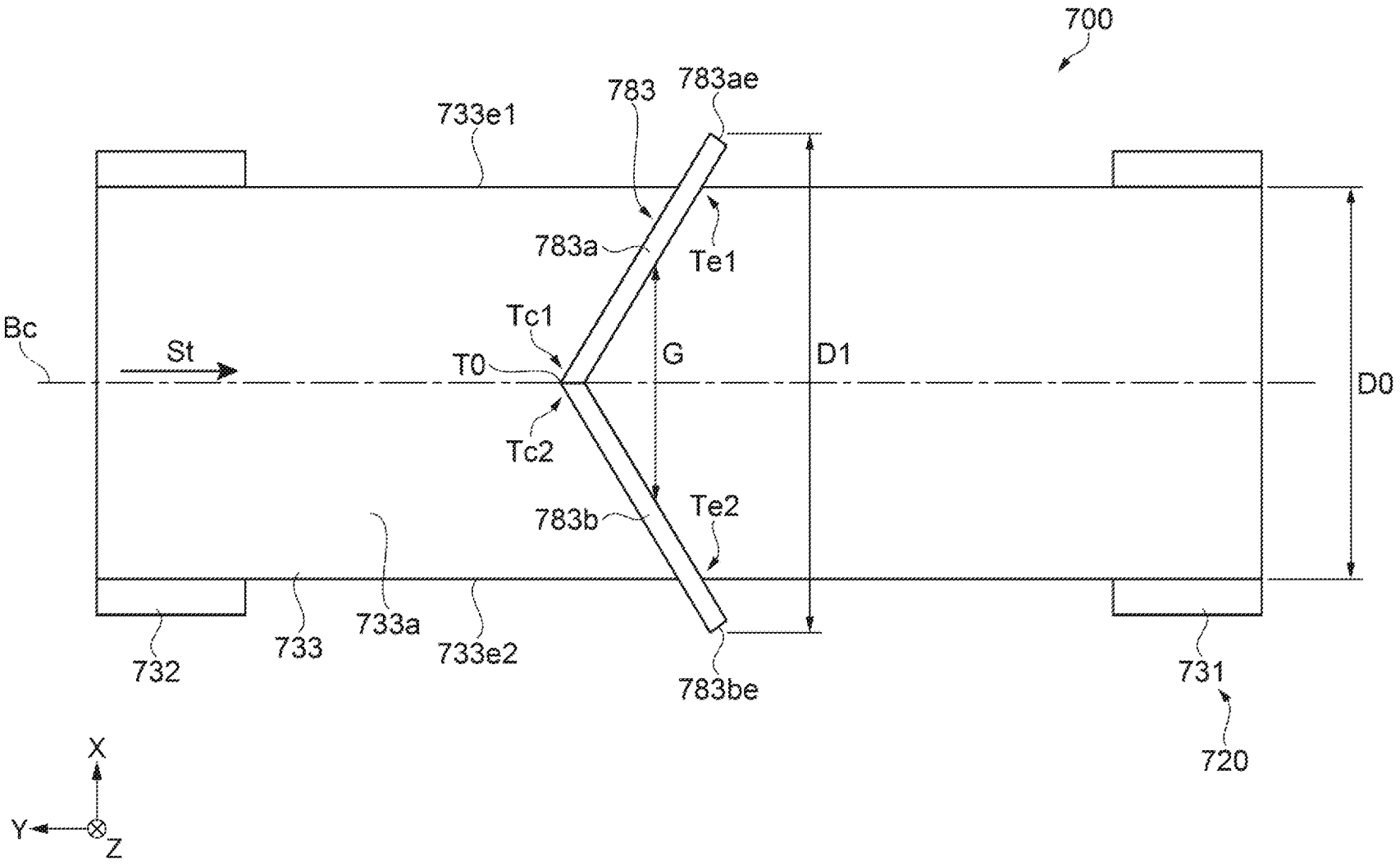
FIG. 13 is a plan view illustrating a configuration of a contact portion according to the eighth exemplary embodiment.

As illustrated in FIG. 13, the wiper blade 783 includes a first contact portion 783*a* and a second contact portion 783*b* that are inclined in mutually different directions with respect to the movement direction St of the transporting belt 733.

When a direction orthogonal to the movement direction St and along the transporting belt 733 is an orthogonal direction, the range D1 provided with the first contact portion 783*a* and the second contact portion 783*b* in the orthogonal direction is wider than the width dimension D0 of the transporting belt 733 in the orthogonal direction, and the gap G between the first contact portion 783*a* and the second contact portion 783*b* in the orthogonal direction increases in the movement direction St.

Note that, a detailed configuration of the wiper blade 783 is similar to that of the first exemplary embodiment, and thus descriptions thereof will be omitted.

According to the present exemplary embodiments, obliquity of the transporting belt 733 can be suppressed. This allows object W to be transported in a desired direction.

Note that, in the present exemplary embodiment, the wiper blade 783 is disposed below the transporting belt 733, but may be disposed in other regions. In addition, the wiper blade 783 may be configured to contact not only the front surface 733*a* of the transporting belt 733, but also the inner circumferential surface 733*b*. Even in this way, obliquity of the transporting belt 733 can be suppressed.

9. Other Exemplary Embodiments

For example, the wiper blade 83 and the rotary brush 483 may be configured in combination. In this case, the wiper blade 83 is disposed downstream of the rotary brush 483. Furthermore, a configuration may be adopted in which the rotary brush 483 is disposed inside the cleaning tank 81, and cleaning liquid in the cleaning tank 81 is caused to adhere to the transporting belt 33. As a result, the cleaning of the transporting belt 33 and suppression of obliquity can be efficiently performed. Additionally, the wiper blade 83 may be employed as a first contact portion, and the rotary brush 483 may be employed as a second contact portion.

In addition, in the exemplary embodiments described above, the wiper blade 83 and the rotary brush 483 as the contact portions have been described as the examples, but the present disclosure is not limited thereto, and a member capable of contacting the transporting belt 33, for example, a plate-like plastic member, a brush, or the like may be used.

In addition, a mechanism may be provided in which when the movement direction St of the transporting belt 33 is changed to a reverse direction, respective directions in which the first contact portion 83*a* and the second contact portion 83*b* are inclined are changed to respective reverse directions, for example.

What is claimed is:

1. A recording device, comprising:

a recording unit configured to perform recording on a medium;

a transporting belt configured to transport the medium; and a first contact portion and a second contact portion contacting the transporting belt, and inclined in mutually different directions with respect to a movement direction of the transporting belt, wherein when a direction orthogonal to the movement direction and along the transporting belt is an orthogonal direction, a range, in which the first contact portion and the second contact portion are provided, in the orthogonal direction is wider than a width dimension of the transporting belt in the orthogonal direction, and an interval between the first contact portion and the second contact portion in the orthogonal direction increases in the movement direction.

2. The recording device according to claim 1, wherein at least one of the first contact portion and the second contact portion is a wiper blade.

3. The recording device according to claim 1, wherein at least one of the first contact portion and the second contact portion is a rotary brush.

4. The recording device according to claim 3, comprising:

a driving portion configured to drive the rotary brush, wherein the rotary brush rotates generating a speed difference from a speed in the movement direction of the transporting belt.

5. The recording device according to claim 4, comprising:

a control unit configured to control the driving portion, wherein the control unit, when determining that movement of the transporting belt in the orthogonal direction is not eliminated, variably controls rotational torque applied to the rotary brush.

6. A transport device, comprising:

a transporting belt configured to transport an object; and a first contact portion and a second contact portion contacting the transporting belt, and inclined in mutually different directions with respect to a movement direction of the transporting belt, wherein when a direction orthogonal to the movement direction and along the transporting belt is an orthogonal direction, a range, in which the first contact portion and the second contact portion are provided, in the orthogonal direction is wider than a width dimension of the transporting belt in the orthogonal direction, and an interval between the first contact portion and the second contact portion in the orthogonal direction increases in the movement direction.

* * * * *